US010244840B2

(12) United States Patent
Zhu et al.

(10) Patent No.: US 10,244,840 B2
(45) Date of Patent: Apr. 2, 2019

(54) JEWELRY STORAGE DEVICE AND DISPLAY METHOD THEREOF

(71) Applicant: Shenzhen Dikai Industrial Co., Ltd., Shenzhen, Guangdong (CN)

(72) Inventors: Xiu Ling Zhu, Shenzhen (CN); Gary Bruce Peckham, Shenzhen (CN)

(73) Assignee: SHENZHEN DIKAI INDUSTRIAL CO., LTD., Shenzhen, Guangdong (CN)

( * ) Notice: Subject to any disclaimer, the term of this patent is extended or adjusted under 35 U.S.C. 154(b) by 408 days.

(21) Appl. No.: 15/076,632

(22) Filed: Mar. 21, 2016

(65) Prior Publication Data

US 2016/0295983 A1 Oct. 13, 2016

(30) Foreign Application Priority Data

Apr. 10, 2015 (CN) ..... 2015 2 0216883 U
Jun. 29, 2015 (CN) ..... 2015 1 0369357

(51) Int. Cl.

| | |
|---|---|
| ***A45C 11/00*** | (2006.01) |
| ***A45C 11/16*** | (2006.01) |
| ***A45C 13/10*** | (2006.01) |
| ***B65D 1/22*** | (2006.01) |
| ***B65D 43/16*** | (2006.01) |

(52) U.S. Cl.

CPC ..... *A45C 11/16* (2013.01); *A45C 13/10* (2013.01); *B65D 1/22* (2013.01); *B65D 43/165* (2013.01)

(58) Field of Classification Search

USPC ..... 292/49, 46, 47, 44, 254; 206/6.1, 566, 206/1.5; 220/249

See application file for complete search history.

(56) References Cited

U.S. PATENT DOCUMENTS 2,800,220 A * 7/1957 Hawver ..... E05B 37/20 206/1.5
3,401,968 A * 9/1968 Testa ..... E05B 63/248 292/127
3,416,655 A * 12/1968 Shiffman ..... A45C 11/16 206/45.24
3,572,538 A * 3/1971 Bergh ..... A45C 11/24 220/829
4,219,116 A * 8/1980 Borkan ..... B65D 50/045 206/1.5

(Continued)

*Primary Examiner* — Jacob K Ackun

(74) *Attorney, Agent, or Firm* — Raymond Y. Chan; David and Raymond Patent Firm

(57) ABSTRACT

A jewelry storage device includes a box body unit and a locking unit. The box body unit includes a first body, and a second body, wherein a plurality of first and second connecting members are formed at rear sides of the first and second bodies respectively and are coupled with each other to pivotally connect the first body with the second body. The locking unit includes a mortice lock member and a locking member provided at front sides of the first and second bodies respectively in a hidden manner. The first and second connecting members are not protruded from the rear sides of the first and second bodies respectively. The mortice lock member and the locking member are not protruded from the front sides of said first and second bodies respectively. Therefore, the box body unit has no protruded portion formed at the first and second bodies.

12 Claims, 15 Drawing Sheets

(56) References Cited

U.S. PATENT DOCUMENTS

| | | | | |
|---|---|---|---|---|
| 5,035,319 | A * | 7/1991 | Kunisch | A45C 11/16 206/566 |
| 5,682,910 | A * | 11/1997 | Kizawa | A45C 13/1084 132/293 |
| 7,367,449 | B2 * | 5/2008 | Kaminski | A45C 11/16 206/1.5 |
| 8,109,541 | B2 * | 2/2012 | Chang | E05B 17/0037 292/101 |
| 8,459,459 | B2 * | 6/2013 | Noble | B65D 83/04 206/1.5 |
| 2004/0154935 | A1 * | 8/2004 | Kaminski | A45C 11/16 206/6.1 |
| 2010/0200581 | A1 * | 8/2010 | Maltz | A01K 97/06 220/4.22 |
| 2010/0294675 | A1 * | 11/2010 | Mangano | A45C 11/04 206/5 |

* cited by examiner

JEWELRY STORAGE DEVICE AND DISPLAY METHOD THEREOF

CROSS REFERENCE OF RELATED APPLICATION

This is a non-provisional application that claims priority to Chinese application number CN 201520216883.X, filing date Apr. 10, 2015 and Chinese application number CN 201510369357.1, filing date Jun. 29, 2015, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a jewelry storage and display device, and more particularly to a jewelry storage device and display method thereof, wherein when the jewelry storage device is folded in a storage position, there is no protrusion protruded from an outer surface of the device, such that the device will not be clasped with any external object to prevent any damage of the device and the external object.

Description of Related Arts

With the improvement of peoples' living standard, the quality of the jewelries is enhanced. Each of the jewelries needs to be separately placed into the jewelry storage device in order to be stored and displayed, and at the same time, the quality and price levels of the jewelry and the jewelry storage device need to be matched, so the jewelry storage device is designed to store and display the jewelry.

There are two types of traditional jewelry storage devices. One type of jewelry storage device comprises a box cover and a box base, which are two separated items components. When the jewelry storage device is in use, the box cover is arranged to cover on the box base to protect the jewelries placed inside. Since the box cover and the box base are two separate components, the box cover is easy to be detached from the box base. For example, when the box cover is detached from the box base during the transportation of the jewelry storage device, the jewelries will drop out from the jewelry storage device, and then the jewelries will be broken and lost.

Referring to FIG. 1 and FIG. 2 of the drawings, an improved jewelry storage device is provided, wherein the improved jewelry storage device comprises a box cover 10P, a box base 20P, a set of control assembly 30P, and a connecting axle 40P. The box cover 10P comprises a front cover side 11P, and a rear cover side 12P corresponding to the front cover side 11P. Correspondingly, the box base 20P has a front base side 21P and a rear base side 22P corresponding to the front base side 21P. The box cover 10P comprises at least one first connecting member 13P integrally extended from the front cover side 12P of the box cover 10P. The box base 20P comprises at least one second connecting member 23P integrally extended from the front base side 21P of the box base 20P, wherein the first and second connecting members 13P and 23P are connected with each other by the connecting axle 40P, so as to connect the box base 10P and the box cover 20P with each other.

The front cover side 11P of the box cover 10P comprises a locking member 14P. The front base side 21P of the box base 20P has a sliding cavity 24P and a sliding channel 25P communicated with the sliding cavity 24P, wherein the control assembly 30P comprises a breaking member 31P and a control member 32P, wherein the breaking member 31P is located inside the sliding cavity 24P, wherein the control member 32P is arranged on the front base side 21P of the box base 20P, and the control member 32P is operatively connected with the breaking member 31P, wherein the locking member 14P has a locking slot 141P, wherein while the box cover 10 is covered on the box base 20P, the locking member 14P can be passed through the sliding channel 25P and moved along the sliding cavity 24P, so that the breaking member 31P can be automatically locked into the locking slot 141P of the locking member 14P by an elastic member 33, and while the breaking member 31P is operatively moved by the control member 32P, the box cover 10P is able to be covered on the box base 20P. As a result, the jewelries can be stored between the box cover 10P and the box base 20P.

It is worth mentioning that the front side and the rear side of the traditional jewelry storage device has a protruded structure. Generally speaking, the control member 32P is arranged on the front cover side 11P of the box cover 10P and the front rear side 21P of the box base 20P. The first connecting member 13P and the second connecting member 23P are arranged on the rear cover side 12P of the box cover 10P and the rear base side 22P of the box base 20P respectively. During the transportation of the traditional jewelry storage devices, a clearance will be generated between two adjacent jewelry storage devices as the jewelry storage devices cannot overlapped with each other side by side, so that two adjacent jewelry storage devices will be moved and collided with each other, and then the jewelries stored inside the jewelry storage device will be shaken and broken. In addition, during the transportation of the traditional jewelry storage device, the control member 32P is easy to be actuated and the box cover 10P is accidentally opened from the box base 20P, so that the jewelries stored inside the jewelry storage device will fall out therefrom and will be broken and damaged.

Nowadays, while the jewelries are displayed, the jewelries are placed inside the showcase, and the lights of the showcase are projected on the jewelries in order to enhance the aesthetic appearance of the jewelries. It is worth mentioning that different jewelries placed in the same showcase under the same light arrangement will provide different display effects. The representation of the jewelries via the light arrangement and the jewelry storage device will directly affect the sale of the jewelries. However, since the showcase and the light arrangement cannot be customized for each jewelry, the jewelry storage device will play a major role to enhance the display appearance of the jewelry.

SUMMARY OF THE PRESENT INVENTION

The invention is advantageous in that it provides a jewelry storage device, wherein when the jewelry storage device is folded in a storage position, there is no protrusion protruded from outer surfaces of the device, such that during transportation of the device, the device will not be clasped with any external object to prevent any damage of the device and the external object.

Another advantage of the invention is to provide a jewelry storage device and display method thereof, wherein since the outer surfaces of the jewelry storage device are flat that no protrusion is protruded thereon, the devices can be placed side-by-side without any clearance formed therebetween during transportation of the devices, so as to prevent any collision or vibration between the adjacent jewelry storage devices.

Another advantage of the invention is to provide a jewelry storage device and display method thereof, wherein the jewelry storage device comprises a box body unit and a locking unit, wherein the box body unit comprises a first body and a second body coupled with the first body, and the first and second bodies can be folded between a storage position and a display position, and the first body and the second body are interchangeable between the storage and display positions of the jewelry storage device, and the locking unit is adapted to retain the first body and second body at the storage position.

Another advantage of the invention is to provide a jewelry storage device and display method thereof, wherein a storage cavity is formed between the first body and second body while the jewelry storage device is at the storage position, and the display cavity is formed between the first body and second body while the jewelry storage device at the display position.

Another advantage of the invention is to provide a jewelry storage device and display method thereof, wherein the display method of the jewelry storage device is provided to match with different kinds of jewelries, and no specific display base is needed to display the jewelries, so the jewelry storage device not only can provide better display effects, but also can decrease the cost for displaying the jewelries.

Another advantage of the invention is to provide a jewelry storage device, wherein the jewelry storage device is able to display the jewelries anywhere, and not limited to display the jewelries in the showcase.

Additional advantages and features of the invention will become apparent from the description which follows, and may be realized by means of the instrumentalities and combinations particular point out in the appended claims.

According to the present invention, the foregoing and other objects and advantages are attained by a jewelry storage device, comprising:

a locking unit; and a box body unit, wherein the locking unit is hidden inside the box body, and the box body unit comprises a first body and a second body coupled with the first body, wherein the first and second bodies are folded between a storage position and a display position, wherein the first body and the second body are interchangeable between the storage and display positions of the jewelry storage device, wherein the locking unit is adapted to automatically lock the first and second bodies together while the first body and the second body are interchangeable between the storage and display positions, and a storage cavity is formed between the first and second bodies.

According to a first alternative mode of a preferred embodiment of the present invention, the first body comprises at least one first connecting members downwardly, and curvedly extended from the rear side of the first body, and the second body comprises at least one second connecting members downwardly, and curvedly extended from the rear side of the second body, and the box body unit further comprises a connecting axle, wherein the connecting axle passes through each of the first and second connecting members, so the first and second bodies are able to be pivotally moved with each other along the connecting axle to fold between the storage position and the display position.

According to a first alternative mode of a preferred embodiment of the present invention, the locking unit comprises a mortice lock member and a locking member, wherein the mortice lock member is provided on the first body, and the locking member is provided on the second body in a hidden manner, wherein the second body comprises a locking slot communicating with the locking member, wherein the locking member is adapted to automatically lock up with the mortice lock member while the mortice lock member is inserted into the locking slot.

According to a second alternative mode of a preferred embodiment of the present invention, the locking unit comprises a mortice lock member and a locking member, wherein the mortice lock member is provided on the second body, and the locking member is provided on the first body in a hidden manner, wherein the second body comprises a locking slot communicating with the locking member, wherein the locking member is adapted to automatically lock up with the mortice lock member while the mortice lock member is inserted into the locking slot.

According to a first alternative mode of the present invention, the second body comprises a sliding slot and a sliding cavity, wherein and the sliding cavity and the locking slot are communicated with each other. The locking member further comprises an operative member, a breaking unit, and a reinstate member, wherein the operative member is movably arranged inside the sliding slot, and the breaking unit is movably arranged inside the sliding cavity, wherein the reinstate member is arranged between the front side of the second body and the breaking unit, so when the operative member is actuated by an external force to move the breaking unit from its original position, the reinstate member is forced to be deformed, so the operative member and the breaking unit will reinstate to their original positions.

According to a second alternative mode of the present invention, the first body comprises a sliding slot and a sliding cavity, wherein and the sliding cavity and the locking slot are communicated with each other. The locking member further comprises an operative member, a breaking unit, and a reinstate member, wherein the operative member is movably arranged inside the sliding slot, and the breaking unit is movably arranged inside the sliding cavity, wherein the reinstate member is arranged between the front side of the first body and the breaking unit, so when the operative member is actuated by an external force to move the breaking unit from its original position, the reinstate member is forced to be deformed, so the operative member and the breaking member will reinstate to their original positions.

In accordance with another aspect of the invention, the present invention comprises, a display method for a jewelry storage device according to a preferred embodiment of the present invention is illustrated, wherein the jewelry storage device comprises a first body and a second body, wherein the first and second bodies are folded between a storage position and a display position, wherein a storage cavity is formed between the first and second bodies while the first and second bodies are in the storage position, wherein when the first and second bodies are moved at the display position, a display cavity is formed between the first and second bodies; and while the first and second body are moved from the display position to the storage position, the locking unit is adapted to automatically lock the first and second bodies with each other, so as to maintain the first and second bodies in the storage position.

According to the preferred embodiment of the present invention, the jewelry storage device further comprises the lighting unit comprising at least one lighting member arranged inside an inner side of the first body, so that while the first body and the second body are moved the display position, the lighting member can selectively provide different colors and brightness of lighting effects for the display cavity, and the lighting effect provided by the lighting members can be applied on the jewelries placed inside the display cavity.

According to the preferred embodiment of the present invention, the jewelry storage device further comprises a video member arranged inside an inner side of the first body, so that while the first body and the second body are moved at the display position, the video member can be automatically activated to record environmental images around the box body unit.

According the preferred embodiment of the present invention, the jewelry storage device further comprises a storing member and a communicating member communicatively connected with the storing member, wherein the communicating member is communicatively connected with the storing member, and the users' personal information collected by the processing and collecting member can not only be stored into the storing member, but also be transported to certain designated position through the communicating member.

According to the preferred embodiment of the present invention, the jewelry storage device further comprises a display member, and the display member is selectively arranged on an inner wall or outer wall of the first body, and is communicatively connected with the storing member.

According to the preferred embodiment of the present invention, the jewelry storage device comprises a first body and a second body, wherein the first and second bodies are moved between a storage position and a display position. A display method for the above mentioned jewelry storage device comprises steps of:

(a) forming a display cavity between the first and second bodies when the first and second bodies are moved at the display position; and (b) providing the lighting effects from the first body to the display cavity.

The display method further comprises a step (c) of: recording environmental information around the jewelry storage device.

Furthermore, the step (b) further comprises the following steps of:

(b.1) arranging at least one lighting members on an inner wall of the first body; and (b.2) providing lighting effects generated from the lighting member to the display cavity.

Furthermore, the step (c) comprises following steps of:

(c.1) arranging a video member on an inner wall of the first body; and (c.2) recording environmental information around the jewelry storage device by the video member.

In addition, the step (b.2) further comprises a step of:

automatically providing the lighting effects while the first and second bodies are moved from the storage position to the display position.

Furthermore, the step (c.2) further comprises a step of: automatically recording the environmental information around the jewelry storage device while the first and second body are exchanged from the storage position to the display position.

Furthermore, in the step (d), the locking unit comprises a mortice lock member and a locking member, wherein the mortice lock member is arranged on the first body, and the locking member is provided on the second body in a hidden manner, wherein the second body comprises a locking slot communicating with the locking member, and when the mortice lock member is inserted into the locking slot, the locking member is automatically locked up with the mortice lock member.

Furthermore, in the step (d), the locking unit comprises a mortice lock member and a locking member, wherein the mortice lock member is arranged on the second body, and the locking member is provided on the first body in a hidden manner, wherein the first body comprises a locking slot communicating with the locking member, and when the mortice lock member is inserted into the locking slot, the locking member is automatically locked up with the mortice lock member Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
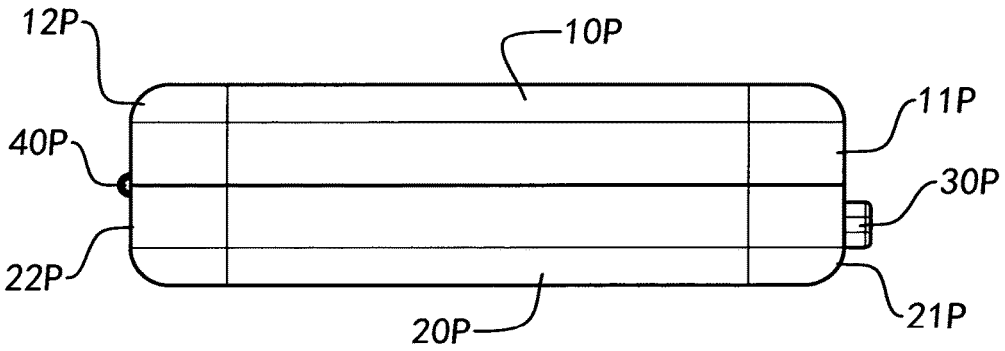
Fig. 1 Prior Art
FIG. 1 is a side view of a current jewelry storage device.
Figure 2:
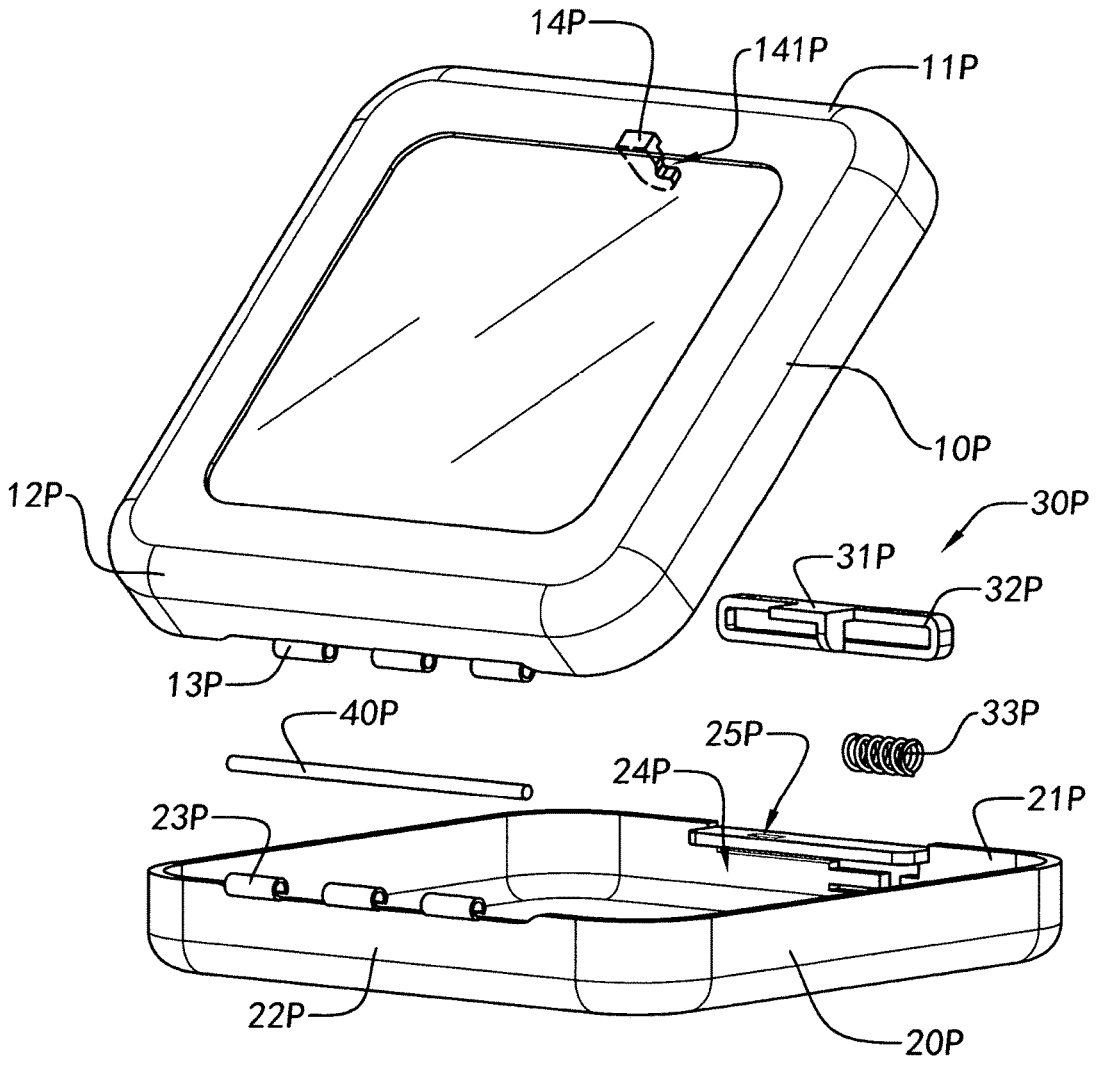
Fig. 2 Prior Art
FIG. 2 is a sectional view of a current jewelry storage device.
Figure 3A:
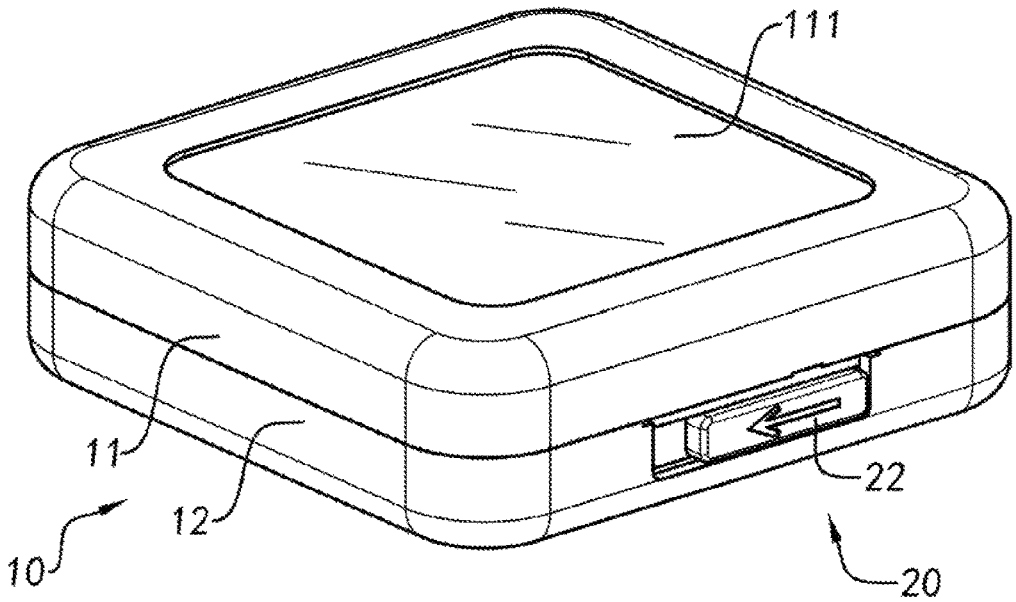
FIG. 3A is a perspective view of a jewelry storage device according to a preferred embodiment of the present invention, illustrating the jewelry storage device is at the storage position.
Figure 3B:
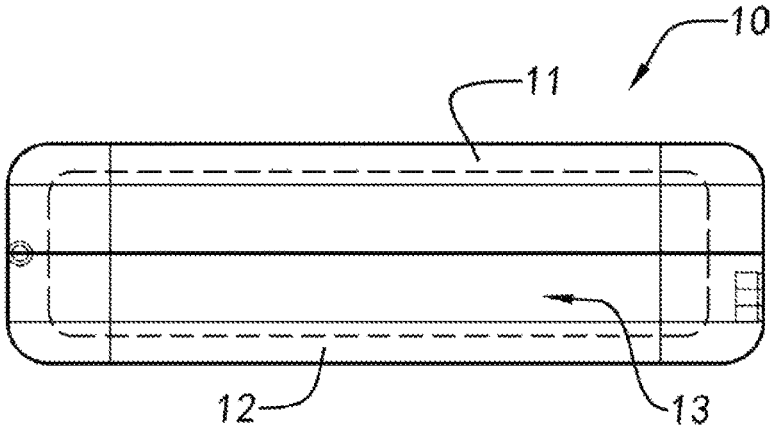
FIG. 3B is a side view of a jewelry storage device according to a preferred embodiment of the present invention, illustrating the jewelry storage device at the storage position.
Figure 3C:
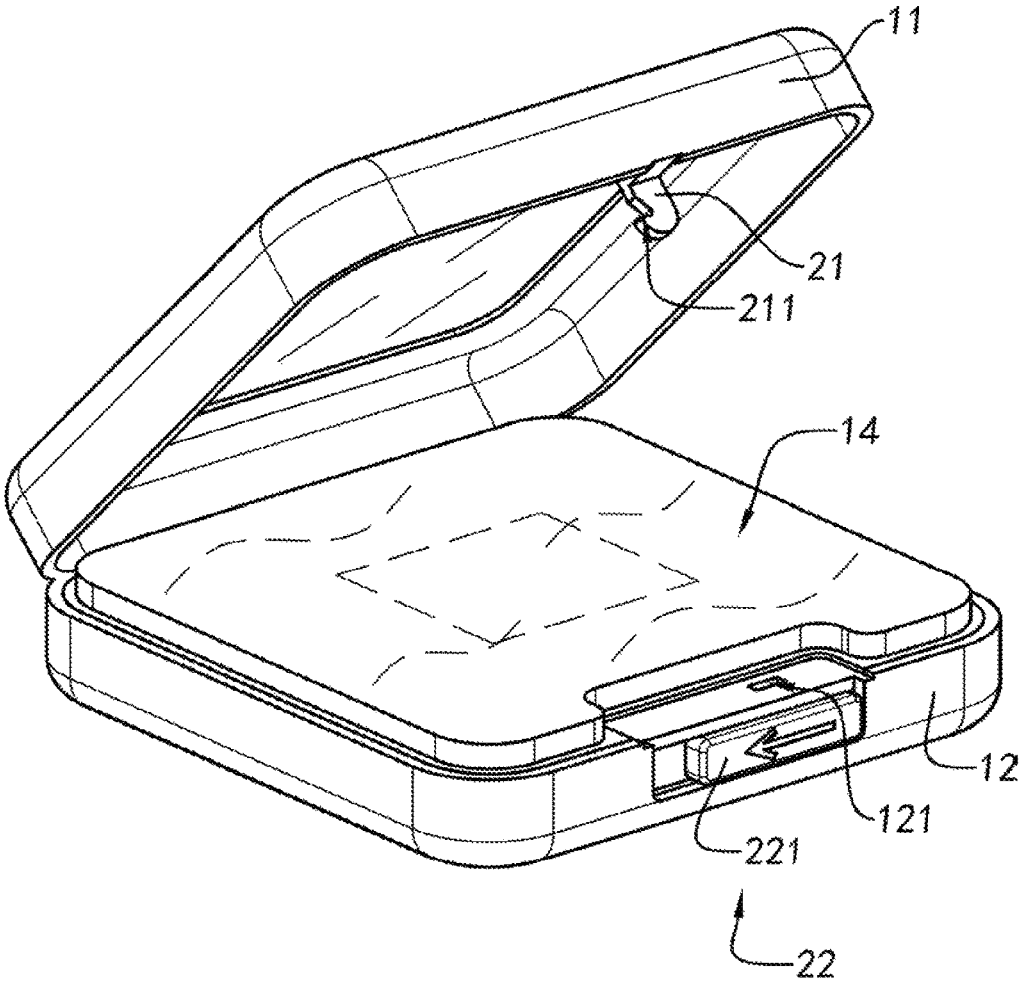
FIG. 3C is an exploded view of a jewelry storage device according to a preferred embodiment of the present invention, illustrating the jewelry storage device at the storage position.
Figure 4:
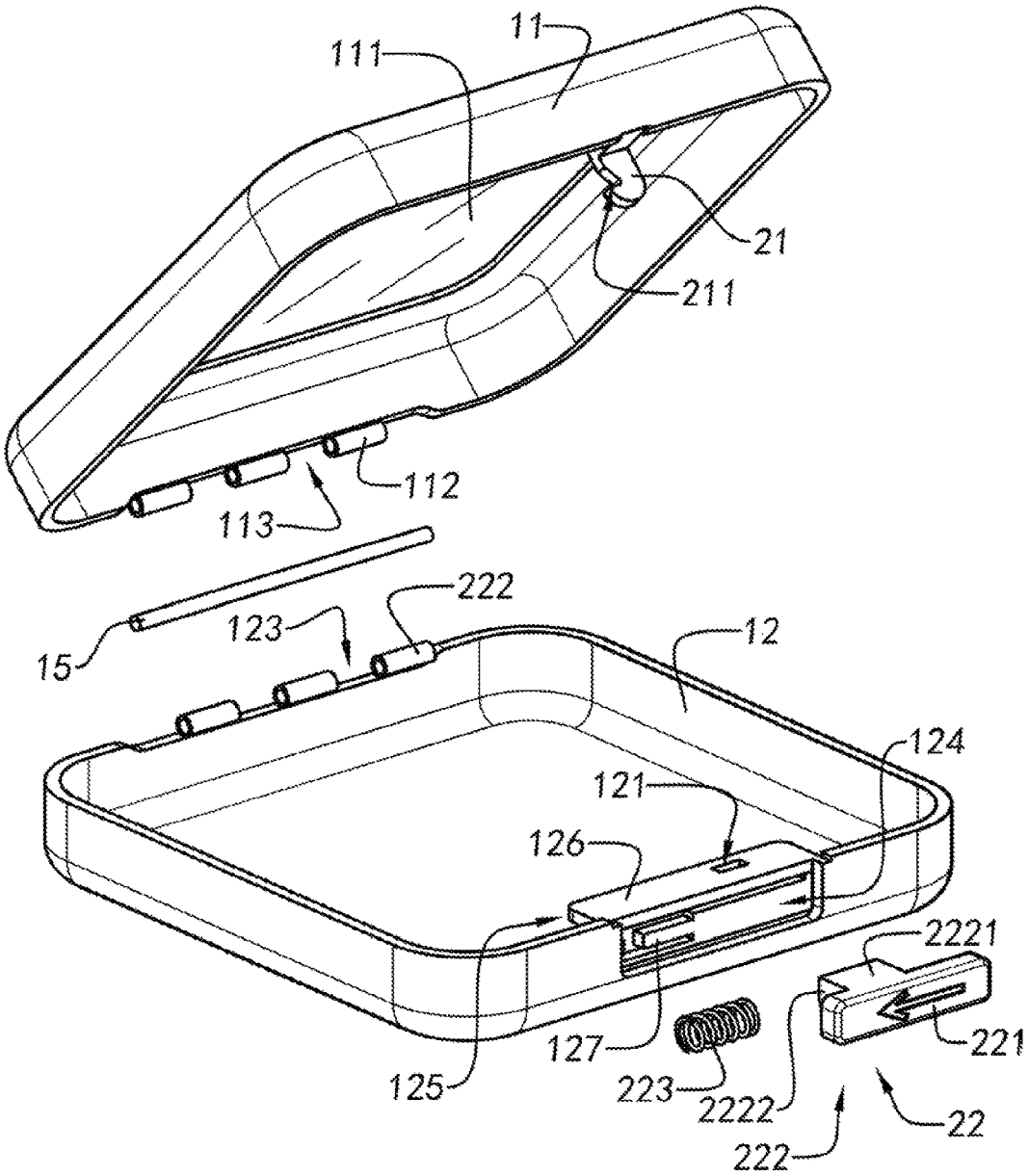
FIG. 4 is a sectional view of a jewelry storage device according to a preferred embodiment of the present invention.

Referring to FIG. 3A to FIG. 4 of the drawings, a jewelry storage device according to a preferred embodiment of the present invention is illustrated, wherein the jewelry storage device comprises a box body unit 10 and a locking unit 20, wherein the locking unit 20 is arranged and hidden inside the box body unit 10, so that an outer surface of the box body 10 doesn't have any protruded portion, and the locking unit 20 is adapted to lock up the box body unit 10.

The box body unit 10 comprises a first body 11 and a second body 12, wherein the first and second bodies 11, 12 are moved between a storage position and a display position, wherein the first body 11 and the second body 12 are interchangeable between the storage and display positions of the jewelry storage device, and the first and second bodies 11, 12 can provide different functions with respect to the storage and display positions of the jewelry storage device. The locking unit 20 is adapted to automatically lock the first and second body 11, 12 together while the first body 11 and the second body 12 are moved between the storage and display positions, wherein the locking unit 20 is adapted to maintain the first and second bodies 11, 12 at the storage position. While an external force is forced on the first and second body 11, 12, the storage position of the first and second body 11, 12 will not be changed, so that the storage position of the jewelry storage device can be ensured.

Preferably, the first and second bodies 11, 12 are coupled with each other. While the first and second body 11, 12 are interchangeable between the storage and display positions, the first and second bodies 11, 12 will not be detached from each other, so as to prevent either the first or second bodies 11, 12 being lost.

According to the above preferred embodiment of the present invention, the first body 11 is designed to a box cover of the jewelry storage device, and the second body 12 is designed to a box base of the jewelry storage device, and when the first and second bodies 11, 12 are in the storage position, a storage cavity 13 is formed between the first and second bodies 11, 12.

It is worth mentioning that when the first and second bodies 11, 12 are in the storage position, the first body 11 of the jewelry storage device can be overlappedly covered on the second body 12 thereof, wherein the storage cavity 13 is formed between the first and second bodies 11, 12 to store the jewelries thereinside. Accordingly, when the first and second bodies 11, 12 are moved at the display position, a display cavity 14 is formed between the first and second bodies 11, 12, and in the display position, the jewelries can be removed from the display cavity 14. That is to say, the storage cavity 13 is formed between the first and second bodies 11, 12 while the jewelry storage device is in the storage position, and the display cavity 14 is formed between the first and second bodies 11, 12 while the jewelry storage device in the display position.

The locking unit 20 comprises a mortice lock member 21 and a locking member 22, wherein the mortice lock member 21 is arranged on the first body 11, and the locking member 22 is provided on the second body 12 in a hidden manner, wherein the mortice lock member 21, having a hook structure, is inwardly extended from the first body 11. The second body 12 comprises a locking slot 121 communicating with the locking member 22, wherein while the first and second bodies 11, 12 are moved from the display position to the storage position, the mortice lock member 21 of the first body 11 is inserted into the locking slot 121 of the second body 12 to actuate the locking member 22. The locking member 22 is adapted to automatically lock on the mortice lock member 21 so as to ensure the first and second bodies 11, 12 being maintained in the storage position. The locking member 22 is able to be operated to unlock the mortice lock member 21, and at the same time, the first and second bodies 11, 12 can be moved from the storage position to the display position.

The first body 11 comprises a transparent portion 111 formed thereon, and the storage cavity 13 can be seen through the transparent portion 111 while the first and second bodies 11, 12 are moved at the storage position. For example, the jewelries stored inside the storage cavity 13 is seen through the transparent portion 111 of the first body 11. It is worth mentioning that the material of the transparent portion 111 of the first body 11 can be different than other parts of the first body 11, wherein the first body 11 can be made of metal, but is not limited. The transparent portion 111 can be made of glass or acrylic glass.

A rear side of the first body 11 is coupled with a rear side of the second body 12, wherein the mortice lock member 21 is arranged on a front side of the first body 11, and the locking member 22 is formed on a front side of the second body 12 in a hidden manner, wherein the locking member 22 is not protruded from the front side of the second body 12, so that while the jewelry storage device is carried or transported, the locking member 22 will not be actuated by adjacent objects. On the other hand, the locking member 22 will not be accidently actuated by an external force, and the first and second bodies 11, 12 will not be forced to open in order to ensure the security of the jewelries placed inside the storage cavity 13.

Generally speaking, the first body 11 comprises two or more first connecting member members 112, each having a curved structure, downwardly extended from the rear side of the first body 11, wherein a first clearance 113 is formed between two adjacent first connecting members 112. Accordingly, the second body 11 comprises two or more second connecting members 122, each having a curved structure, downwardly extended from the rear side of the second body 12, wherein a second clearance 123 is formed between two adjacent second connecting members 122. The box body unit 10 further comprises a connecting axle 15, wherein the first connecting members 112 of the first body 11 are disposed at the second clearances 123 of the second body 12 respectively, wherein the second connecting members 122 of the second body 12 are disposed at the first clearances 113 of the first body 11 respectively, so that the first connecting members 112 and the second connecting members 122 are spacedly arranged with each other, wherein the connecting axle 15 passes through each of the first and second connecting members 112, 122, so the first and second bodies 11, 12 are able to be rotated with each other by the connecting axle 15 to move between the storage position and the display position.

It is worth mentioning that each of the first connecting members 112 is downwardly, inwardly, and curvedly extended from the rear side of the first body 11, and each of the second connecting members 122 is downwardly, inwardly, and curvedly extended from the rear side of the second body 12. When the first body 11 and the second body 12 are maintained in the storage position by the locking unit 20, the rear side of the first and second body 11, 12 has no protruded surface. The locking member 22 is hiddenly arranged inside the second body 12, so no protruded surface is formed on the rear side of the first and second bodies 11, 12. On the other hand, when the first and second bodies 11, 12 of the jewelry storage device are in the storage position, no protruded surface is formed on the first and second bodies 11, 12. When the jewelry storage devices are transported, no clearances are formed between adjacent jewelry storage devices, so that there is no collision or vibration between two adjacent jewelry storage devices. On the other hand, when the jewelry storage device is carried by the users, the locking member 22 will not be accidently actuated, and will not be clasped by other adjacent objects.

Referring to FIG. 4 of the drawings, the second body 12 comprises a sliding slot 124 formed on an outer side of the second body 12, and a sliding cavity 125 formed on an inner side of the second body 12, so that the sliding slot 124 and the sliding cavity 125 are communicated with each other, and the sliding cavity 125 and the locking slot 12 are communicated with each other. That is to say, the sliding slot 124 and the sliding cavity 125 are formed on the outer side and inner side of the front side of the second body 12 respectively, and the locking member 22 is hiddenly arranged inside the sliding cavity 125 and the sliding slot 124, so that no protruded surface is formed on the front side of the second body 12.

The locking member 22 further comprises an operative member 221, a breaking unit 222, and a reinstate member 223, wherein the operative member 221 is operatively arranged on the breaking unit 222, and the operative member 221 is arranged inside the sliding slot 124, and the breaking unit 222 is arranged inside the sliding cavity 125, wherein the reinstate member 223 is arranged between the front side of the second body 12 and the breaking unit 222. When the operative member 221 is actuated by an external force to move the breaking unit 222 from its original position, the reinstate member 223 is forced to be deformed, and then the operative member 221 and the breaking unit 222 will reinstate to their original positions. Preferably, the operative member 221 and the breaking unit 222 of the locking member 22 are integrally formed to be an integrated member. For example, the operative member 221 and the breaking unit 222 of the locking member 22 are formed by a bended metal sheet.

It is worth mentioning that the mortice lock member 21 is formed on the first body 11 of the jewelry storage device, and the locking member 22 is arranged on the second body 12 of the jewelry storage device in a hidden manner.

Figure 5A:
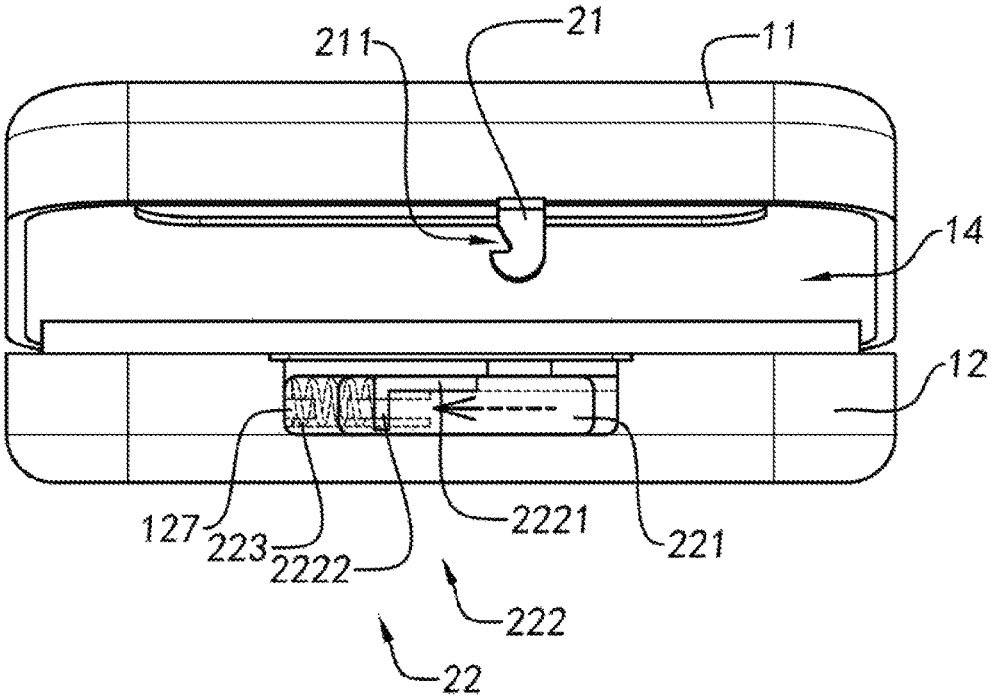
FIG. 5A is an inner structural view of a jewelry storage device according to a preferred embodiment of the present invention, illustrating the first and second bodies being moved from the storage position to the display position.

Referring to FIG. 5A of the drawings, the first and second bodies 11, 12 are interchangeable to move from the storage position to the display position.

Figure 5B:
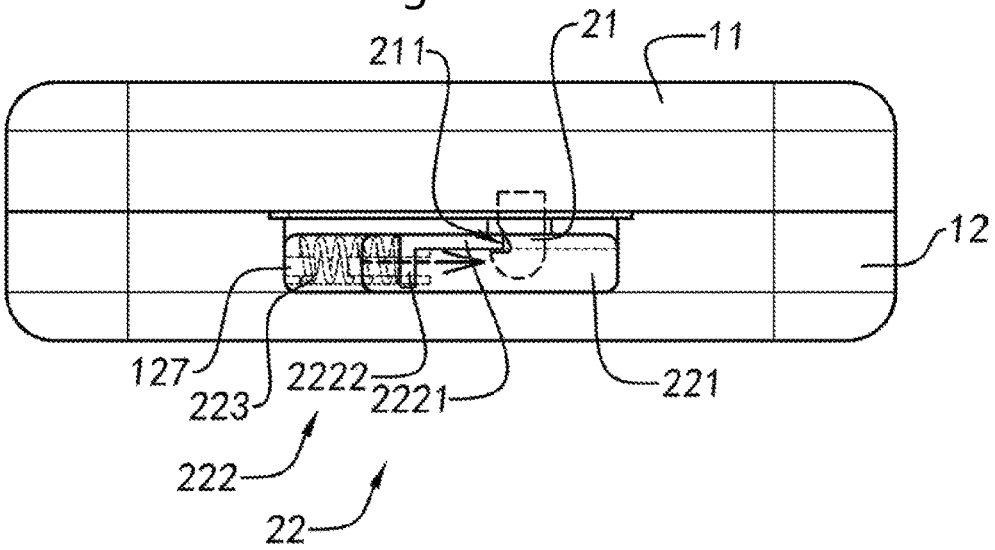
FIG. 5B is an inner structural view of a jewelry storage device according to a preferred embodiment of the present invention, illustrating the first and second bodies being moved from the display position to storage position.

Generally speaking, while an external force is exerted on the operative member 221 to force the operative member 221 moving along the sliding slot 124 from right to left side, and then the breaking unit 222 is moved along the sliding cavity 125, which is synchronously moved along the operative member 221. The mortice lock member 21 can be actuated to unlock by the breaking unit 222, so the first and second bodies 11, 12 are rotated with each other along the connecting axle 15. While the breaking unit 222 is actuated to move its original position by the external force, the reinstate member 223 is compressed by the breaking unit 222 to generate a reinstate force. Therefore, while the external force is released, the reinstate force will be exerted on the operative member 221 and the reinstate member 222 to force the operative and reinstate member 221, 222 returning to their original positions. Referring to FIG. 5B of the drawings, the operative member 221 will be moved along the sliding slot 124 by the reinstate force generated by the reinstate member 222.

As shown in FIG. 5B, the first body 11 and the second bodies 12 are operated to move from the display position to the storage position.

Generally speaking, when the external force is exerted on the first and second bodies 11, 12, the mortice lock member 21 of the first body 11 is inserted into locking slot 121 of the second body 12, and at the same time, the breaking unit 222 is actuated by a free end of the of the mortice lock member 21, so the breaking unit 222 will be forced to move along the sliding cavity 125 to compress the reinstate member 223 to generate a reinstate force. Therefore, the mortice lock member 21 is securely inserted into the locking slot 121, and the breaking unit 222 will be reinstated to its original position by the reinstate member 223 such that the mortice lock member 21 is securely locked inside the locking slot 121, and then the first and second body 11, 12 are retained on the storage position.

It is worth mentioning that the mortice lock member 21 comprises a locking groove 211, wherein while the mortice lock member 21 is inserted into the locking slot 121, the breaking unit 222 is moved to a position corresponding to the locking member 211 of the mortice lock member 21, wherein the breaking unit 222 is automatically moved into the locking groove 211 of the mortice lock member 21 by the reinstate force generated by the reinstate member 223, so the mortice lock member 21 is locked by the breaking unit 222 to prevent the mortice lock member 21 being slipped from the locking slot 121.

That is to say, the locking member 22 is adapted to automatically lock on the mortice lock member 21 while the mortice lock member 21 is inserted into the locking slot 121 of the second body 12, so as to change the positions of first and second bodies 11, 12 from the display position to the storage position. The operative member 221 can be actuated by one hand of the user.

It is worth mentioning that the locking slot 121 is inwardly extended from an inner front side of the second body 12; the front side of the second body 12 is inwardly and curvedly extended to form a supporting platform 126. Referring to FIG. 4 of the drawings, the locking slot 121 is formed on the supporting platform 126, and the locking slot 121 is communicated with the sliding cavity 125.

The breaking unit 222 comprises a breaking member 2221 and a blocking member 2222, wherein the blocking member 2222 is curvedly extended from the breaking member 2221, wherein the operative member 221 is operatively arranged on the breaking member 2221. The breaking member 2221 allows the mortice lock member 21 of the first body 11 being inserted thereinto, or locks at the locking slot 121 of the second body 12 to secure the mortice lock member 21 in position. For example, the breaking member 2221 is able to be retained inside the locking groove 211 of the mortice lock member 21 by the reinstate member 223, wherein the reinstate member 223 is arranged between the front end of the second body 12 and the blocking member 2222, so as to prevent the reinstate member 223 being mis-displaced while the breaking unit 222 is operated by the operative member 221.

In addition, the second body 12 further comprises two locating blocks 127 integrally extended from the front end of the second body 12, and two ends of the reinstate member 223 are coupled on the two locating blocks 127 respectively, wherein each of the locating blocks 127 is adapted to maintain the deformation direction of the reinstate member 223, so as to prevent the offset and crookedness of the reinstate member 223.

It is worth mentioning that the reinstate member 223 is a compressing spring, wherein the reinstate member 223 can generate flexible deformation by being compressing by the external force, and if the external force is released, the reinstate member 223 will reinstate to its original position.

Figure 6:
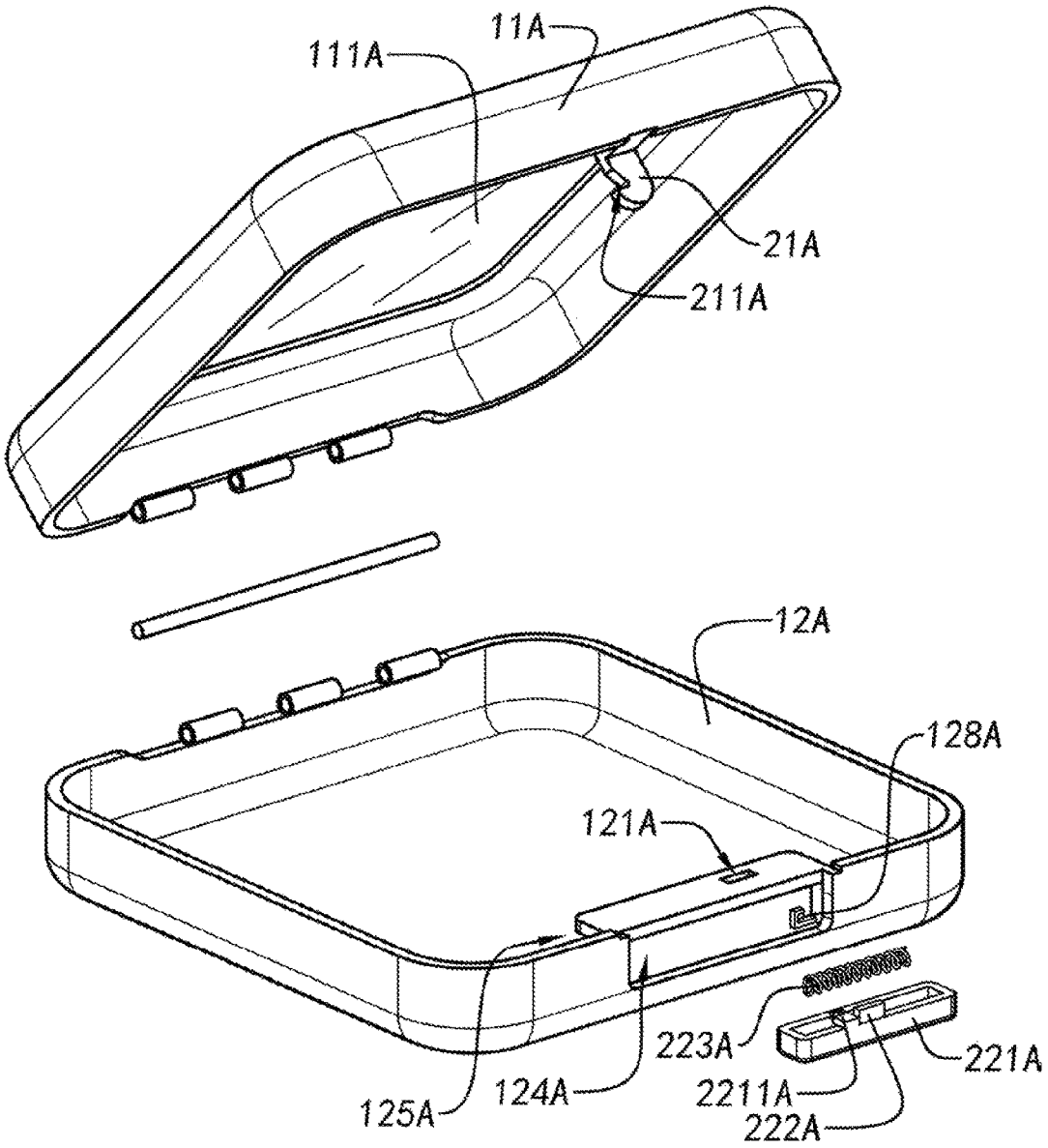
FIG. 6 is a sectional view of an alternative mode of the jewelry storage device according to the above preferred embodiment of the present invention.
Figure 7A:
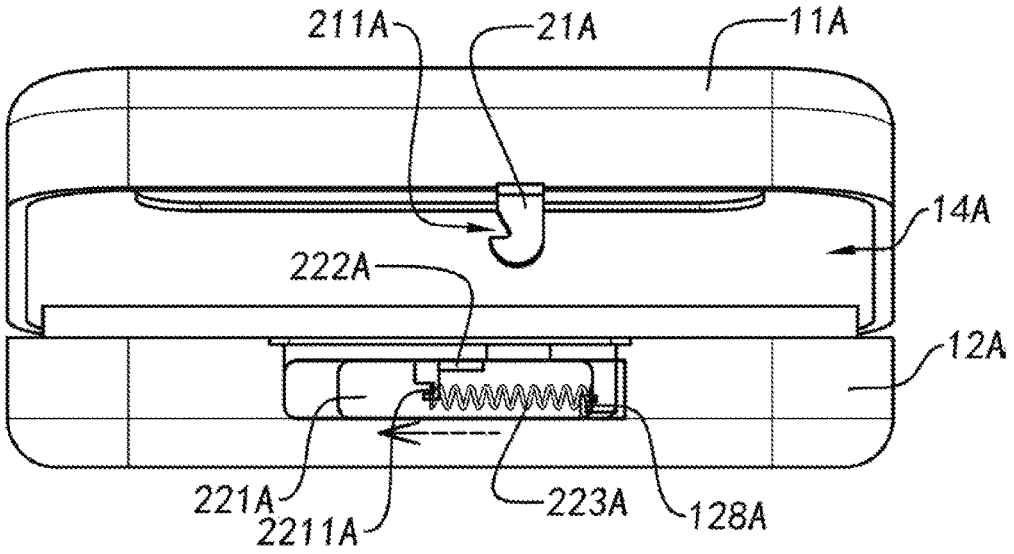
FIG. 7A is an inner structural view of an alternative mode of the jewelry storage device according to the above preferred embodiment of the present invention, illustrating the first and second bodies being moved from the storage position to the display position.
Figure 7B:
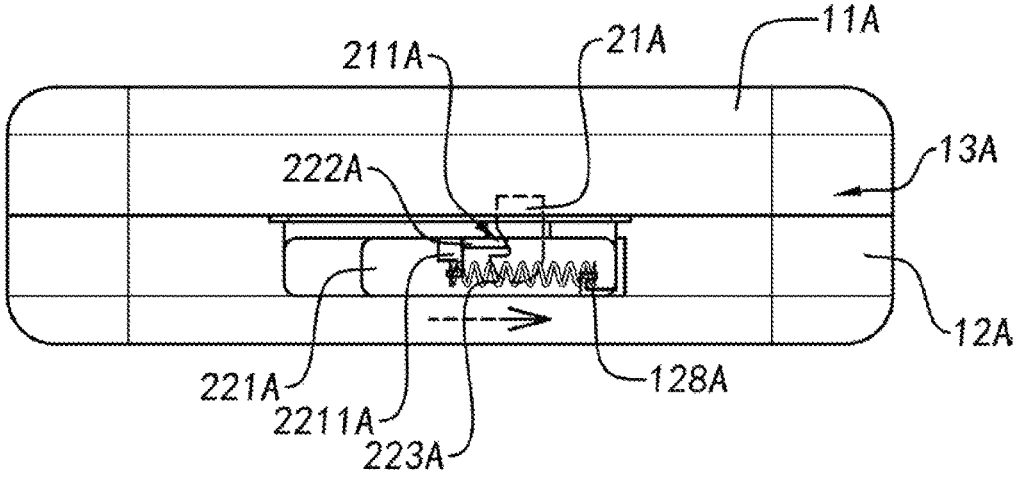
FIG. 7B is an inner structural view of an alternative mode of the jewelry storage device according to the above preferred embodiment of the present invention, illustrating the first and second bodies being moved from the display position to the storage position.

Referring to FIG. 6 to FIG. 7B of the drawings, a jewelry storage device according to an alternative mode of the above preferred embodiment of the present invention is illustrated, wherein the jewelry storage device comprises a box cover 10A and a locking unit 20A, wherein the locking unit 20A is arranged inside the box cover 10A in a hidden manner, and the locking unit 20A is adapted to retain the box cover 10A at different positions.

The box cover 10A comprises a first body 11A and a second body 12A, wherein the first and second bodies 11A, 12A are moved between a storage position and a display position, wherein the first body 11A and the second body 12A are interchangeable between the storage and display positions of the jewelry storage device. Preferably, the first and second bodies 11A, 12A are coupled with each other. While the first and second bodies 11A, 12A are folded between the storage and display positions, the first and second bodies 11A, 12A will not be detached from each other, so as to prevent either the first or second body 11A, 12A being lost. The locking unit 20A is adapted to lock the first and second bodies 11A, 12A with each other while the first and second bodies 11A, 12A are moved from the display position to the storage position, so the locking unit 20A is able to secure the first and second bodies 11A, 12A at the storage position.

A storage cavity 13A is formed between the first and second bodies 11A, 12A while the first and second bodies 11A, and 12A are in the storage position. Accordingly, when the first and second bodies 11A, 12A are in the display position, a display cavity 14A is formed between the first and second bodies 11A, 12A, and in the display position, the jewelries can be removed from the display cavity 14A. That is to say, the storage cavity 13A is formed between the first and second bodies 11A, 12A while the jewelry storage device is in the storage position, and the display cavity 14A is formed between the first and second bodies 11A, 12A while the jewelry storage device in the display position.

A rear side of the first body 11A is coupled on a rear side of the second body 12A, wherein the locking unit 20A is adapted to automatically lock the front side of the first and second body 11A, 12A, so as to retain the first and second bodies 11A, 12A at the storage position. The locking unit 20A comprises a mortice lock member 21A and a locking member 22A, wherein the mortice lock member 21A is arranged on the front side of the first body 11A, and the locking member 22A is arranged on the front side of the second body 12A in a hidden manner, wherein the front side of the second body 12A comprises a locking slot 121A communicating with the locking member 22A, wherein while the first and second bodies 11A, 12A are moved from the display position to the storage position, the mortice lock member 21A of the first body 11A is inserted into the locking slot 121A of the second body 12A, so as to actuated the locking member 22A, wherein the locking member 22A is adapted to automatically lock on the mortice lock member 21A so as to ensure the first and second bodies 11A, 12A being retained in the storage position. The locking member 22A is able to be operated to unlock the mortice lock member 21A, and at the same time, the first and second bodies 11A, 12A can be moved from the storage position to the display position.

Referring to FIG. 6 of the drawings, the front side of the second body 12A comprises a sliding slot 124A inwardly formed from an outer side of the second body 12A, and a sliding cavity 125A formed from an inner side of the second body 12. That is to say, the sliding cavity 125A and the sliding slot 124A are formed on two different sides of the second body 12A, and the locking member 22A is hiddenly arranged inside the sliding cavity 125A and the sliding slot 124A, so that no protruded surface is formed on the front side of the second body 12A. Therefore, while the jewelry storage device is carried or transported, the locking member 22A will not be actuated by adjacent objects in order to ensure the security of the jewelries inside the storage cavity 13A.

The locking member 22A further comprises an operative member 221A, a breaking unit 222A, and a reinstate member 223A, wherein the operative member 221A is operatively arranged on the breaking unit 222A, and the operative member 221A is arranged inside the sliding slot 124A, and the breaking unit 222A is arranged inside the sliding cavity 125A, wherein the reinstate member 223A is arranged between the front side of the second body 12A and the breaking unit 222A. When the operative member 221A is actuated by an external force to force the breaking unit 222A being moved its original position, the reinstate member 223A is forced to be deformed, so that the operative member 221A and the breaking unit 222A will reinstate to their original positions.

It is worth mentioning that the mortice lock member 21A is formed the first body 11 of the jewelry storage device, and the locking member 22A is hiddenly arranged on the second body 12A of the jewelry storage device. The difference of this alternative mode is that the reinstate member 223A is an expansion spring, so that the reinstate member 223A can be expanded to generate flexible deformation by the external force, and after the external force is released, the reinstate member 223A will reinstate to its original position.

Preferably, the front side of the second body 12A comprises a first locating member 128A, and the operative member 221A comprises a second locating member 2211A arranged between the breaking unit 222A and the operative member 221A, and two ends of the reinstate member 223A are coupled on the first locating member 128A and the second locating member 2211A respectively, so while a flexible deformation is generated by reinstate member 223A, wherein the first and second locating members 128A, 2211A will not be detached from the two ends of the reinstate member 223A, so as to maintain the stability of the locking unit 20A.

As shown in FIG. 7A, the first body 11A and the second body 12A are operated to move from the storage position to the display position.

Generally speaking, when the external force is exerted on the operative member 221A to actuated the operative member 221A moving along the sliding slot 124A from right to left side, the breaking unit 222A will be forced to synchronously move along the sliding cavity 125A, and the mortice lock member 21A is unlocked by the breaking unit 222A, so that the first body 11A and the second body 12A coupled with the first body 11A can generate a relative rotation motion. While the breaking unit 222A is actuated to move its original position, the reinstate member 223A is expanded by the breaking unit 222A to generate a reinstate force. After the external force exerted on the operative member 221A is released, the operative member 221A and the reinstate member 222A will return to their original positions by the reinstate force.

As shown in FIG. 7B, the first body 11A and the second body 12A are operated to move from the display position to the storage position.

Generally speaking, when the external force is exerted on the first and second bodies 11A, 12A, the mortice lock member 21A of the first body 11A is inserted into locking slot 121A of the second body 12A, and at the same time, the breaking unit 222A is activated by a free end of the of the mortice lock member 21A, so the breaking unit 222A will be forced to move along the sliding cavity 125A, and the reinstate member 223A is expanded to generate a reinstate force. Therefore, the mortice lock member 21A is securely inserted into the locking slot 121A, and the breaking unit 222A will be reinstated to its original position by the reinstate member 223A such that the mortice lock member 21A is securely locked inside the locking slot 121A, and then the first and second body 11A, 12A are retained on the storage position.

It is worth mentioning that the mortice lock member 21A comprises a locking groove 211A, wherein while the mortice lock member 21A is inserted into the locking slot 121A, the breaking unit 222A is moved to a position corresponding to the locking member 211A of the mortice lock member 21A, wherein the breaking unit 222A is automatically moved into the locking groove 211A of the mortice lock member 21A by the reinstate force generated by the reinstate member 223A, so the mortice lock member 21A is locked by the breaking unit 222A to prevent the mortice lock member 21A being slipped from the locking slot 121A.

That is to say, the locking member 22A is adapted to automatically lock on the mortice lock member 22A while the mortice lock member 21A is inserted into the locking slot 121A of the second body 12A, so as to move the first and second bodies 11A, 12A from the display position to the storage position. The operative member 221A can be actuated by one hand of the user.

Referring to FIG. 8 to FIG. 10B of the drawings, a jewelry storage device according to a second alternative mode of the above preferred embodiment of the present invention is illustrated, wherein the jewelry storage device comprises a box cover 10B and a locking unit 20B, wherein the locking unit 20B is hiddenly arranged inside the box cover 10B, and the locking unit 20B is adapted to lock up the box cover 10B.

The box cover 10B comprises a first body 11B and a second body 12B, wherein the first and second bodies 11B, 12B are moved between a storage position and a display position, wherein the first body 11B and the second body 12B are interchangeable between the storage and display positions of the jewelry storage device. Preferably, the first and second bodies 11B, 12B are coupled with each other. While the first and second bodies 11B, 12B are interchangeably moved between the storage and display positions, the first and second bodies 11B, 12B will not be detached from each other, so as to prevent either the first or second bodies 11B, 12B being lost. The locking unit 20B is adapted to lock the first and second bodies 11B, 12B with each other while the first and second bodies 11B, 12B are moved from the display position to the storage position, so the locking unit 20B is able to secure the first and second bodies 11B, 12B at the storage position.

A storage cavity 13B is formed between the first and second bodies 11B, 12B while the first and second bodies 11B, and 12B are in the storage position. Accordingly, when the first and second bodies 11B, 12B are in the display position, a display cavity 14B is formed between the first and second bodies 11B, 12B, and in the display position, the jewelries can be removed from the display cavity 14B. That is to say, the storage cavity 13B is formed between the first and second bodies 11B, 12B while the jewelry storage device is in the storage position, and the display cavity 14B is formed between the first and second bodies 11B, 12B while the jewelry storage device in the display position.

A rear side of the first body 11B is coupled on a rear side of the second body 12B, wherein the locking unit 20B is adapted to automatically lock the front side of the first and second body 11B, 12B, so as to retain the first and second bodies 11B, 12B in a storage position. The locking unit 20B comprises a mortice lock member 21B and a locking member 22B, wherein the mortice lock member 21B is arranged on the front side of the second body 12B, and the locking member 22B is arranged on the front side of the first body 11B in a hidden manner, wherein the front side of the first body 11B comprises a locking slot 121B communicating with the locking member 22B, wherein while the first and second bodies 11B, 12B are moved from the display position to the storage position, the mortice lock member 21B of the first body 11B is inserted into the locking slot 121B of the second body 12B, so as to actuate the locking member 22B being automatically lock on the mortice lock member 21B, and ensure the first and second bodies 11B, 12B being retained in the storage position. The locking member 22B is able to be operated to unlock the mortice lock member 21B, and at the same time, the first and second bodies 11B, 12B can be moved from the storage position to the display position.

Figure 8:
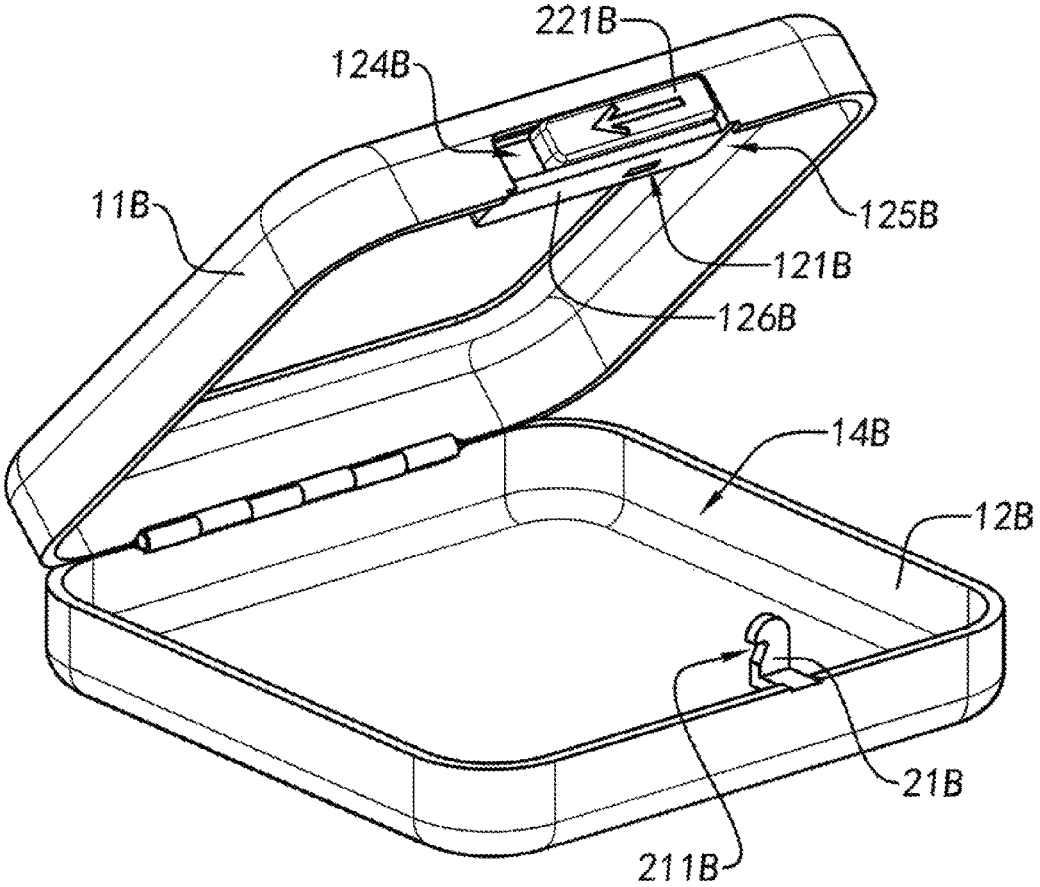
FIG. 8 is a perspective view of a second alternative mode of the jewelry storage device according to the above preferred embodiment of the present invention, illustrating the first and second bodies at the display position.
Figure 9:
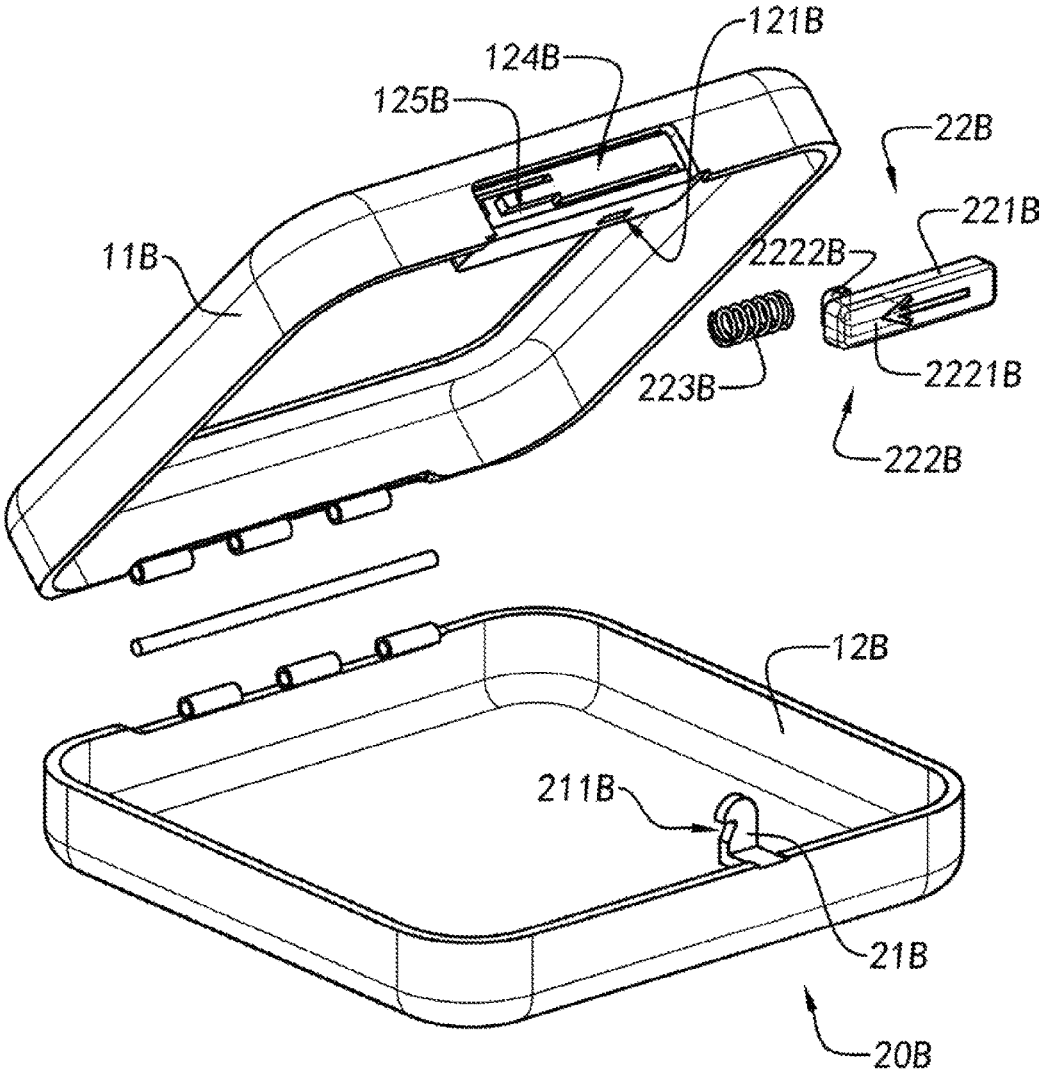
FIG. 9 is a sectional view of a second alternative mode of the jewelry storage device according to the above preferred embodiment of the present invention.

Referring to FIG. 8 of the drawings, the front side of the first body 11B comprises a sliding slot 124B inwardly formed from an outer side of the first body 11B, and a sliding cavity 125B formed from an inner side of the first body 11B. That is to say, the sliding cavity 125B and the sliding slot 124B are formed on two different sides of the first body 11B, and the locking member 22B is hiddenly arranged inside the sliding cavity 125B and the sliding slot 124B, so that no protruded surface is formed on the front side of the first body 11B, so that while the jewelry storage device is carried or transported, the locking member 22B will not be actuated by adjacent objects in order to ensure the security of the jewelries inside the storage cavity 13B.

The locking member 22B further comprises an operative member 221B, a breaking unit 222B, and a reinstate member 223B, wherein the operative member 221B is operatively arranged on the breaking unit 222B, and the operative member 221B is arranged inside the sliding slot 124B, and the breaking unit 222B is arranged inside the sliding cavity 125B, wherein the reinstate member 223B is arranged between the front side of the first body 11B and the breaking unit 222B. When the operative member 221AB is actuated by an external force to force the breaking unit 222B being changed moved its original position, the reinstate member 223B is forced to generate deformation, so that the operative member 221B and the breaking unit 222B will reinstate to their original positions.

The difference between the third embodiment and the second embodiment is that the mortice lock member 21B is formed the second body 12B of the jewelry storage device, and the locking member 22B is arranged on the first body 11B of the jewelry storage device in a hidden manner.

Preferably, the mortice lock member 21B is inwardly, upwardly, and curvedly extended from the front side of the second body 12B. The mortice lock member 21B comprises a locking groove 211B, wherein while the mortice lock member 21B is inserted into the locking slot 121B, the breaking unit 222B is moved to a position corresponding to the locking member 211B of the mortice lock member 21B. The locking member 22B is adapted to automatically lock on the mortice lock member 22B while the mortice lock member 21B is inserted into the locking slot 121B of the second body 12B, so as to move the first and second bodies 11B, 12B from the display position to the storage position. The operative member 221B can be actuated by one hand of the user.

Referring to FIG. 8 of the drawings, the front side of the first body 11B is inwardly and curvedly extended to form a supporting platform 126B, wherein the locking slot 121B is arranged on the supporting platform 126B, and the locking slot 121B of the first body 11B is arranged on a position corresponding to the mortice lock member 21B of the second body 12B, so that the locking member 22B can be actuated while the mortice lock member 21B is inserted into the locking slot 121B.

The breaking unit 222B comprises a breaking member 2221B and a blocking member 2222B, wherein the blocking member 2222B is curvedly extended from the breaking member 2221B, wherein the operative member 221B is operatively arranged on the breaking member 2221B. The breaking member 2221B allows the mortice lock member 21B of the second body 11B being inserted into the locking slot 121B of the first body 12 in order to secure the mortice lock member 21B in position. For example, the breaking member 2221B is able to be retained inside the locking groove 211B of the mortice lock member 21B by the reinstate member 223B, wherein the reinstate member 223B is arranged between the front end of the first body 11B and the blocking unit 2222B, so as to prevent the reinstate member 223B being mis-displaced while the breaking unit 222B is operated by the operative member 221B.

In addition, the first body 11B further comprises two locating blocks 127B integrally extended from the front end of the first body 11B, and two ends of the reinstate member 223B are coupled on the two locating blocks 127B respectively, wherein each of the locating blocks 127B is adapted to maintain the deformation direction of the reinstate member 223B, so as to prevent the offset and crookedness of the reinstate member 223B.

Figure 10A:
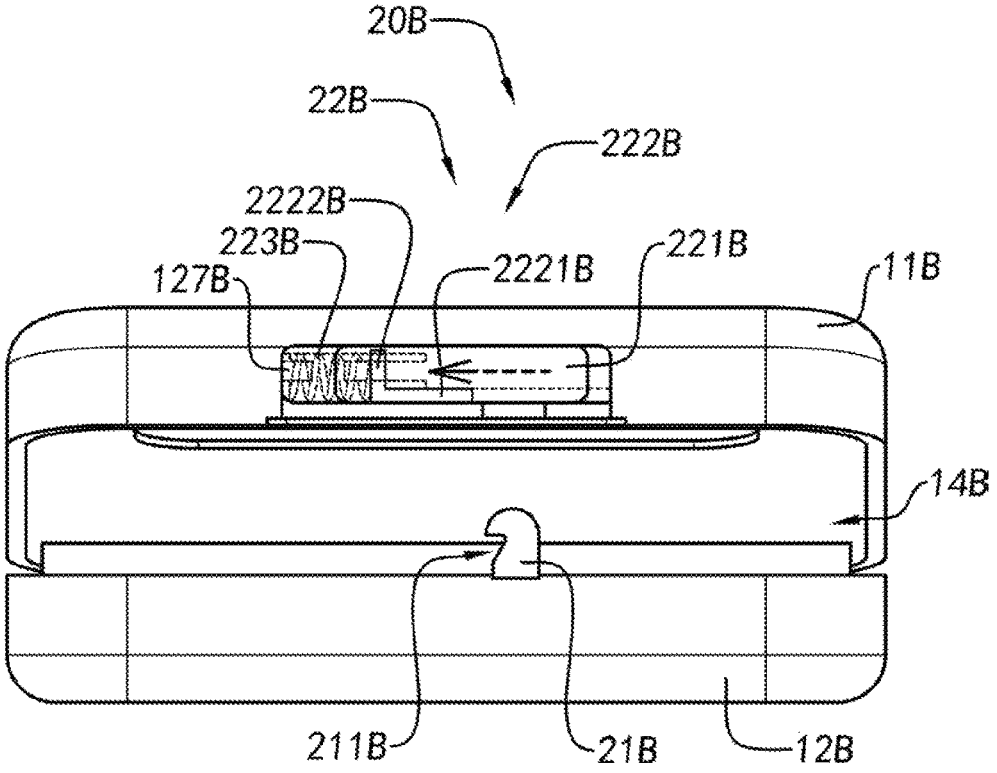
FIG. 10A is a an inner structural view of an second alternative mode of the jewelry storage device according to the above preferred embodiment of the present invention, illustrating the first and second bodies being moved from the storage position to the display position.

As shown in FIG. 10A, the first body 11B and the second body 12B are operated to move from the storage position to the display position.

Generally speaking, when the operative member 221B is activated by the external force to move along the sliding slot 124B from right to left side, the breaking unit 222B will be forced to synchronously move along the sliding cavity 125B, and the mortice lock member 21B is unlocked by the breaking unit 222B, so that the first body 11B and the second body 12B coupled with the first body 11B can generate a relative rotation motion. While the breaking unit 222B is actuated to move its original position, the reinstate member 223B is compressed by the breaking unit 222B to generate a reinstate force. After the external force exerted on the operative member 221B is released, the operative member 221B and the reinstate member 222B will return to their original positions by the reinstate force.

Figure 10B:
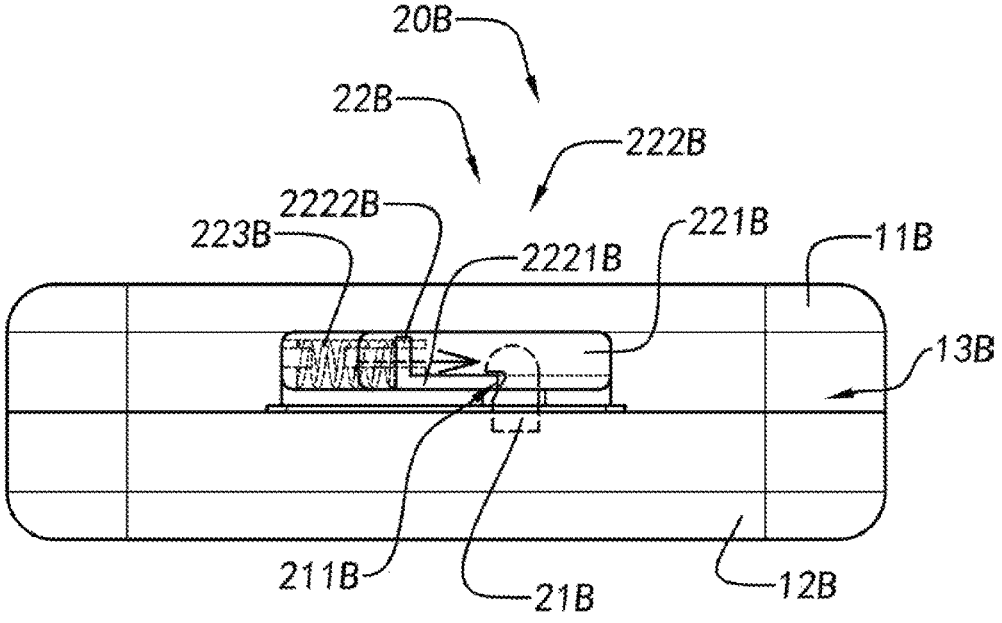
FIG. 10B is an inner structural view of a second alternative mode of the jewelry storage device according to the above preferred embodiment of the present invention, illustrating the first and second bodies being moved from the display position to the storage position.

As shown in FIG. 10B, the first body 11B and the second body 12B are operated to move from the display position to the storage position.

Generally speaking, when the external force is exerted on the first and second bodies 11B, 12B, the mortice lock member 21B of the second body 12B is inserted into locking slot 121B of the first body 11AB, and at the same time, the breaking unit 222B is actuated by a free end of the of the mortice lock member 21B, so the breaking unit 222B will be forced to move along the sliding cavity 125B, and the reinstate member 223B is compressed to generate a reinstate force. Therefore, the mortice lock member 21B is securely inserted into the locking slot 121B, the breaking unit 222B will be reinstated to its original position by the reinstate member 223B such that the mortice lock member 21B is securely locked inside the locking slot 121B, and then the first and second bodies 11B, 12B are maintained on the storage position.

Figure 11:
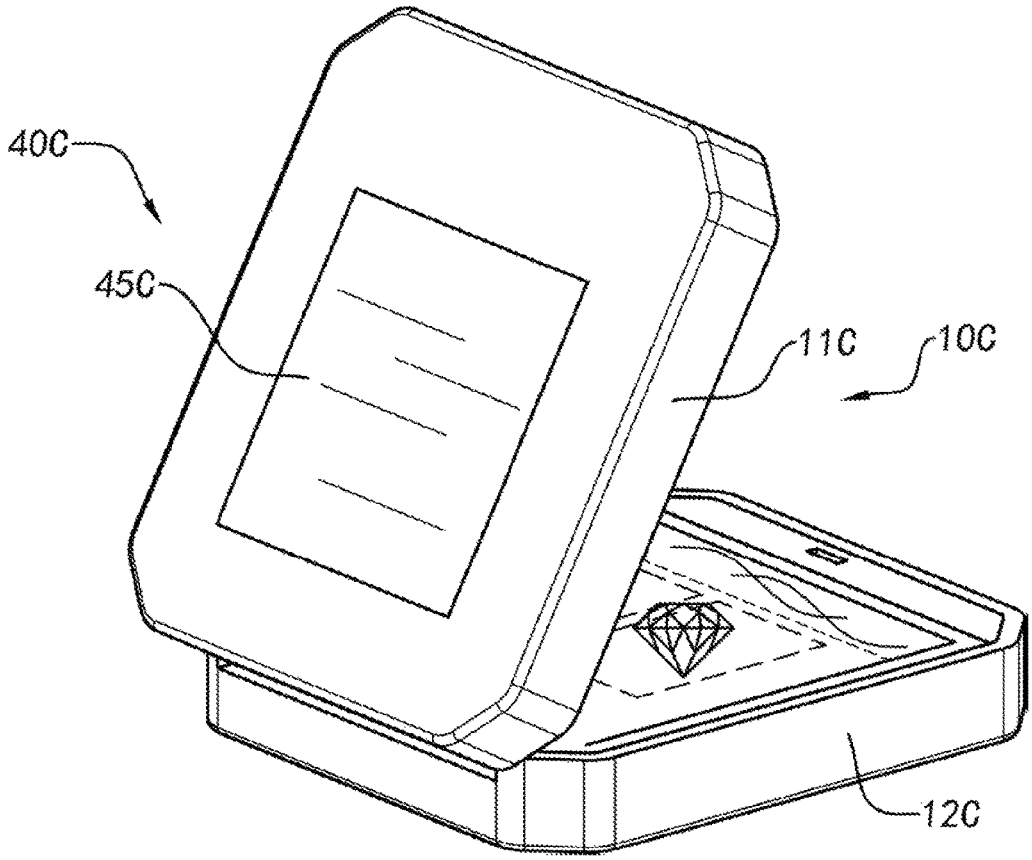
FIG. 11 is a perspective view of a third alternative mode of the jewelry storage device according to the above preferred embodiment of the present invention, illustrating the first and second bodies at the display position.
Figure 12:
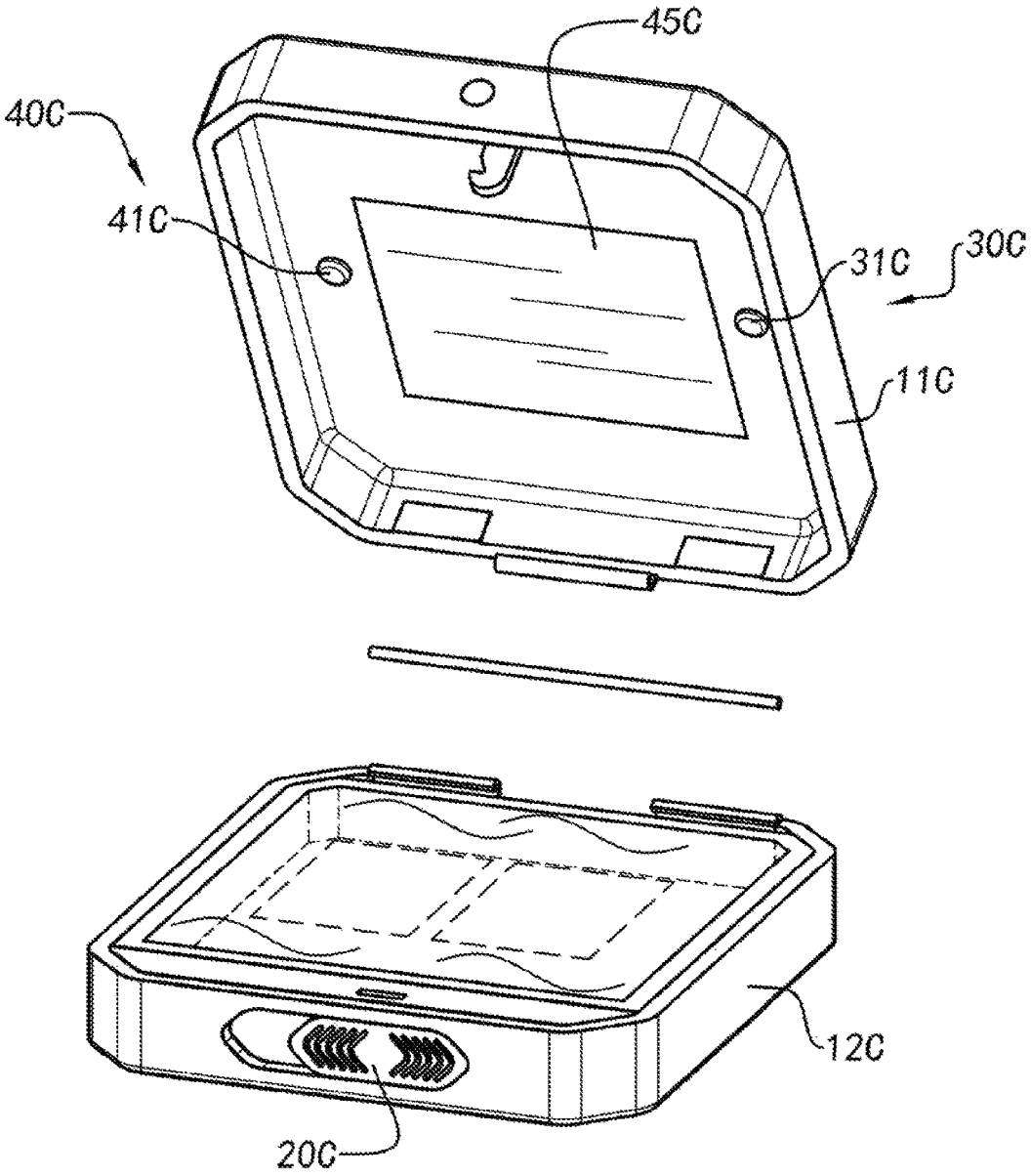
FIG. 12 is a sectional view of a third alternative mode of the jewelry storage device according to a second preferred embodiment of the present invention.
Figure 13:
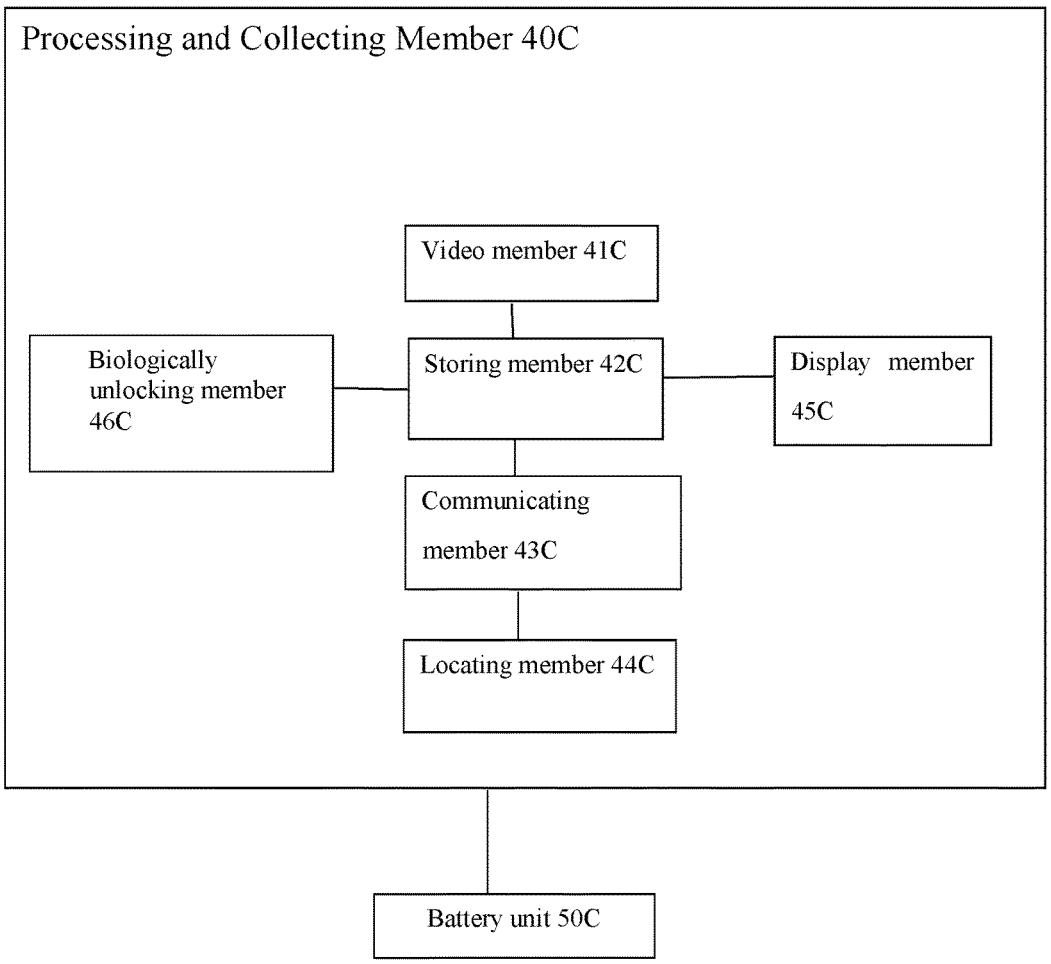
FIG. 13 is a block diagram of a third alternative mode of the jewelry storage device according to a second preferred embodiment of the present invention.

Referring to FIG. 11 to FIG. 13 of the drawings, a jewelry storage device according to a third alternative mode of the above preferred embodiment of the present invention is illustrated, wherein the jewelry storage device comprises a box body unit 10C, a locking unit 20C, and a lighting unit 30C, wherein the locking unit 20C is arranged and hidden inside the box body 10C, so that an outer surface of the box body unit 10C doesn't have any protruded portion, and the locking unit 20C is adapted to control the position of the box body unit 10C, and the lighting unit 30C is arranged on the box body unit 10C.

The box cover 10C comprises a first body 11C and a second body 12C, wherein the first and second bodies 11C, 12C are moved between a storage position and a display position, wherein the first body 11C and the second body 12C are interchangeable between the storage and display positions of the jewelry storage device. The locking unit 20C is adapted to lock the first and second bodies 11C, 12C with each other while the first and second bodies 11C, 12C are moved from the display position to the storage position, so the locking unit 20C is able to secure the first and second bodies 11C, 12C at the storage position.

According to the above preferred embodiment of the present invention, the first body 11C is designed to a box cover of the jewelry storage device, and the second body 12C is designed to a box base of the jewelry storage device, and the first and second bodies 11C, 12C are coupled with each other to prevent either the first or second bodies 11C, 12C being lost while the first and second bodies 11C, 12C are interchangeable between the storage and display positions.

A storage cavity 13C is formed between the first and second bodies 11C, 12C while the first and second bodies 11C, and 12C are in the storage position. Accordingly, when the first and second bodies 11C, 12C are in the display position, a display cavity 14C is formed between the first and second bodies 11C, 12C, and in the display position, the jewelries can be removed from the display cavity 14C. The lighting unit 30C can be actuated while the first and second bodies 11C, 12C are in the display position, so that the lighting effect generated from the lighting unit 30C is applied inside the display cavity 14C so as to improve the aesthetic appearance of the jewelries placed inside the display cavity 14C.

Alternatively, the lighting unit 30C can be activated separately while the first and second bodies 11C, 12C are moved from the storage position to the display position, and the lighting unit 30C also can be synchronously activated while the first and second bodies 11C, 12C are in the display position, and the lighting effect generated from the lighting unit 30C can be applied on the display cavity 14C. On the other hand, the lighting unit 30C can be turned off while the first and second bodies 11C, 12C are moved from display position to the storage position.

The lighting unit 30C comprises one or more lighting members 31C, wherein the lighting members 31C are arranged inside an inner side of the first body 11C, so while the first body 11C and the second body 12C are folded at the display position, the lighting members 31C can selectively provide different colors and brightness of lighting effects to the display cavity 14C, and the lighting effect provided from the lighting members 31C can be applied on the jewelries placed inside the display cavity 14C.

Currently, the jewelries are placed on a display base arranged on a bottom wall inside the jewelry display device, and illuminants are arranged on a top wall inside the jewelry display device, wherein the lighting effects generated from the illuminants can be applied on the display base. The current jewelry display device has many problems. At Firstly, different kinds of jewelries will displayed under the same kind of display condition. However, the display condition is not suitable for the certain jewelry, the quality and aesthetic of the jewelries will be decreased. Secondly, different lighting effects of different jewelry storage displays will be interrupted with each other, so as to reduce the lighting effects.

According to the jewelry display device of the present invention, the jewelry display device and the jewelries need to be matched with each other. That is to say, the jewelry display device can store and carry the jewelries when the jewelries are displayed or are carried by the users, which is a big advantages comparing with the current jewelry display device. In addition, the jewelry display device can provide better quality and aesthetic for the jewelries.

Preferably, the lighting members 31C are LED lighting members, and the lighting members 31C are small in size, so small amount of electric power is required for the lighting members 31C. The capability of the storage cavity 13C formed between the first and second body 11C and 12C is maximum, and the small in size batteries are provided inside the storage cavity 13C.

Furthermore, the jewelry storage device further comprises a processing and collecting member 40C, wherein the processing and collecting member 40C is arranged inside the box body unit 10C. While the jewelry storage device is in use, the processing and collecting member 40C can collect and process the users' personal information.

In addition, the processing and collecting member 40C comprises a video member 41C, a storing member 42C, and a communicating member 43C, wherein the video member 41C is communicatively connected with the storing member 42C, and the communicating member 43C is communicatively connected with the storing member 42C, and the users' personal information collected by the processing and collecting member 40C can be stored in the storing member 42C, and is transported to certain designated position. Preferably, the storing member 42C is a SD (Secure Digital Memory Card), MINI-SD, TF (Trans Flash), MMC (Multimedia Card), or RS-MMC. The communicating member 43C can be a Bluetooth module, Wi-Fi module, infrared module, or other long-distance and short-distance communicating module.

The video member 41C is arranged on the inner side of the first body 11C. Preferably, the video member 41C and the lighting units 30C are arranged on two transparent sides of the first body 11C, and the video member 41C and the lighting units 30C can use a common power supply. That is to say, the processing and collecting member 40C and the lighting units 30C are connected with the same power supply. The storing member 42C and the communicating member 43C are arranged inside the storing cavity 13C formed between the first and second bodies 11C, 12C.

According to the preferred embodiment of the present invention, while the first and second bodies 11C and 12C are interchangeable from the storage position to the storage position, and at the same time, the video member 41C will be automatically activated. In addition, while the first and second bodies 11C, 12C are in the display position, the video member 41C is adapted to record the display condition inside the display cavity 41C. Accordingly, while the first and second bodies 11C, 12C are moved from the display position to the storage position, the video member 41C is automatically turned off. In addition, the video member 41C can be adapted to place towards a connection axle of the first and second bodies 11C, 12C, so the video member 41C can be activated to record the images from the direction of the connection axle of the first and second bodies 11C, 12C.

The information collected by the video member 41C can be a single image or videos. In this manner, the image of the user's face can be collected while the user is opening the jewelry display device in order to record the opening moment of the user. In other words, while the jewelry display device is lost or is stolen, the video member 41C can record the personal information of the thief, so as to easy catch the thief and ensure the secure of the jewelries stored inside the jewelry storage device.

The images collected by the video member 41C can be stored into the storing member 42C, and transmitted to a designated position through a communicating member 43C, wherein the communicating member 43C can be an automatically connecting device, such as a computer. However, the user can receive the images collected by the video member 41C through the communicating member 43C.

The processing and collecting member 40C further comprises a locating member 44C, wherein the locating member 44C is arranged inside the box body unit 10C, and the locating member 41C is communicatively connected with the communicating member 43C. The location of the jewelry display device can be detected by the locating member 43C, and then generate a location signal, and the location signal can be transmitted to the designated position through the locating member 43C. While the jewelry display device is lost or stolen by the thief, the locating member 44C can be used to find the stolen jewelry display device. Preferably, the locating member 44C is a GPS.

It is worth to mention that the locating member 44C can support the user to find the stolen jewelry storage device, and the video member 41C can support the user to find the stolen jewelry storage device and stolen jewelries placed inside the jewelry storage device. For example, while the jewelry storage device is stolen, the locating member 44C can indicate the location of the jewelry storage device, and the video member 41C doesn't need to be activated; when the jewelry storage device is stolen by the thief, and the locating member 44C can detect the location of the jewelry storage device while the first and second body 11C and 12C are not opened. And, if the first and second body 11C, 12C are opened, the video member 41C can be automatically activated, and the face's image of the thief will be record and transmitted to the designated position in order to increase the security of the jewelries.

As shown in FIG. 12, the processing and collecting member 40C further comprises at least one display members 45C, and the display member 45C is selectively arranged on an inner wall or outer wall of the first body 11C, and the display member 45C is communicatively connected with the storing member 42C to display the information stored into the storing member 42C. Preferably, all information relative to the jewelry storage device and the jewelries can be stored into the storing member 42C, and for example, the information includes names, materials, quality levels, prices, and the source of the jewelries. In addition, the images recorded by the video member 41C can be displayed on the display member 45C.

Furthermore, the processing and collecting member 40C further comprises a biologically unlocking member 46C, wherein the biologically unlocking member 46C is communicatively connected to the storing member 42C, and the biologically unlocking member 46C is operatively connected to the locking unit 20C. Certain pre-collected biological information, such as finger prints, face specificity, iris specificity can be pre-stored into the storing member 42C. While the jewelry storage device is in use, the biological information of the user can be collected by the biologically unlocking member 46C, and the biological information need to be matched with the pre-collected biological information stored into the storing member 42C in order to unlock the locking unit 20C, and at the same time, the first and second bodies 11C, 12C can be moved from the storage position to the display position, so as to improve the security of the jewelries stored inside the jewelry storage device. In addition, this kind of biologically unlocking system can prevent the first and second bodies 11C, 12C being accidently opened.

In addition, the jewelry storage device further comprises a battery unit 50C. The battery unit 50C is deposited inside the storing cavity 13C between the first and second body 11C, 12C. And, the battery unit 50C can provide stable electric power to the lighting unit 30C and the processing and collecting member 41C. Preferably, the battery unit 50C is an replaceable battery or re-chargeable battery.

Figure 14:
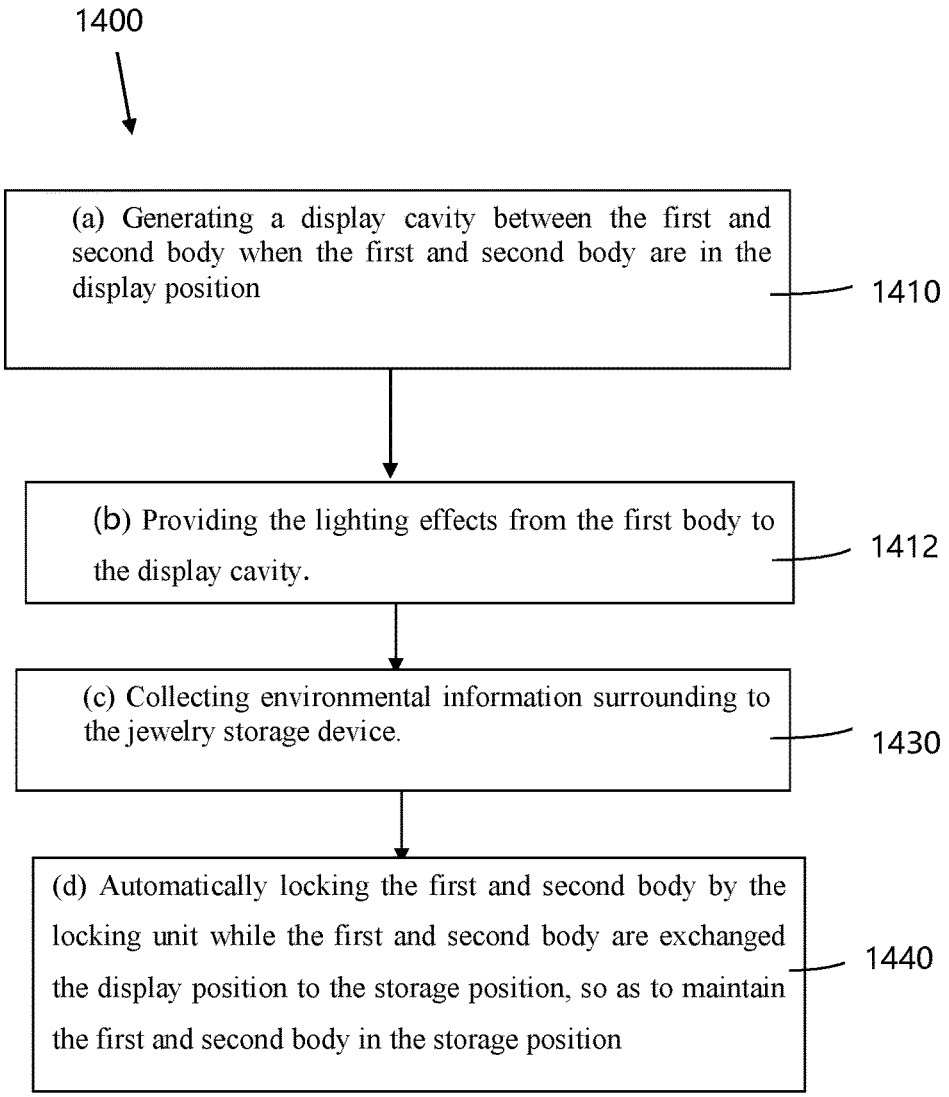
FIG. 14 is a block diagram of a display method for a jewelry storage device a third alternative mode of the jewelry storage device according to the above preferred embodiment of the present invention.

Referring to FIG. 14 of the drawings, a display method 1400 for a jewelry storage device according to a preferred embodiment of the present invention is illustrated, wherein the jewelry storage device comprises a first body 11C and a second body 12C, wherein the first and second bodies 11C, 12C are moved between a storage position and a display position in order to store and display the jewelries respectively. A storage cavity is formed between the first and second bodies 11C, 12C while the first and second bodies 11C, and 12C are in the storage position. Accordingly, when the first and second bodies 11C, 12C are in the display position, a display cavity is formed between the first and second bodies 11C, 12C. The display method 1400 comprises steps of:

Step 1410: (a) forming a display cavity 14C between the first and second bodies 11C, 12C when the first and second bodies 11C, 12C are in the display position;

Step 1420: (b) providing the lighting effects from the first body 11C to the display cavity 14C. The lighting effects can be projected to the jewelries stored inside the display cavity 14C to improve the quality and aesthetic of the jewelries. In addition, the lighting effects can be customized to match with different styles of jewelries so as to significantly improve the display effect of the jewelry storage device.

Furthermore, the step 1420 (*b*) further comprises the following steps of:

(b.1) arranging one or more lighting members 31C on an inner wall of the first body 11C; and (b.2) projecting lighting effects generated from the lighting member 31C to the display cavity 14C.

In addition, the step (b.2) further comprises a step of:

providing the lighting effects automatically while the first and second bodies 11C, 12C are moved from the storage position to the display position.

Referring to FIG. 14 of the drawings, the display method further comprises a step 1430: (c) collecting environmental information around the jewelry storage device.

Furthermore, the step (c) comprises following steps of:

(c.1) arranging a video member 41C on an inner wall of the first body 11C; and (c.2) recording environmental information around the jewelry storage device by the video member 41C.

Furthermore, the step (c.2) further comprises a step of: automatically recording the environmental information around the jewelry storage device while the first and second bodies 11C, 12C are moved from the storage position to the display position.

As shown in FIG. 14, the display method 1400 further comprises a step 1440: (d) automatically locking the first and second bodies 11C, 12C by the locking unit 20C while the first and second bodies 11C, 12C are moved from the display position to the storage position, so as to maintain the first and second bodies 11C, 12C in the storage position.

Furthermore, in the step (d), the locking unit 20C comprises a mortice lock member 21C and a locking member 22C, wherein the mortice lock member 21C is arranged on the first body 11C, and the locking member 22C is arranged on the second body 12C in a hidden manner, wherein the second body 12C comprises a locking slot 121C communicating with the locking member 22C, and when the mortice lock member 21C is inserted into the locking slot 121C, the locking member 22C is automatically locked on the mortice lock member 21C.

Furthermore, in the step (d), the locking unit 20C cannot be actuated especially when the front side of the first body 11C is touched.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A jewelry storage device, comprising:

a box body unit which comprises a first body, a second body, and a connecting axle, wherein said first body comprises a plurality of first connecting members spacedly and inwardly formed at a rear side of said first body, wherein said second body comprises a plurality of second connecting members spacedly and inwardly formed at a rear side of said second body, wherein said first and second connecting members are coupled with each other by said connecting axle to pivotally connect said first body with said second body between a storage position that said second body is covered by said first body, and a display position that said first body is pivotally moved away from said second body, wherein said first and second connecting members are not protruded from said rear sides of said first and second bodies respectively; and a locking unit which comprises a mortice lock member provided at a front side of said first body and a locking member provided at a front side of said second body in a hidden manner, wherein said mortice lock member is releasably coupled to said locking member to lock up said second body with said first body at said storage position, wherein said mortice lock member and said locking member are not protruded from said front sides of said first and second bodies respectively, such that said box body unit has no protruded portion formed at said first and second bodies.

2. The jewelry storage device, as recited in claim 1, wherein a first clearance is formed between two adjacent of said first connecting members and a second clearance is formed between two adjacent of said second connecting members, wherein said first and second connecting members are disposed at said second and first clearances respectively to allow said connecting axle passing through said first and second connecting members so as to pivotally connect said first body with said second body.

3. The jewelry storage device, as recited in claim 1, wherein said locking unit further has a locking slot formed at said second body, wherein said mortice lock member is inserted into said locking slot to couple with said locking member so as to lock up said second body with said first body.

4. The jewelry storage device, as recited in claim 2, wherein said locking unit further has a locking slot formed at said second body, wherein said mortice lock member is inserted into said locking slot to couple with said locking member so as to lock up said second body with said first body.

5. The jewelry storage device, as recited in claim 1, wherein said second body further has a sliding slot formed at an outer side of said second body and a sliding cavity formed at an inner side of said second body to communicate with said sliding slot, wherein said locking member comprises an operative member slidably coupled at said sliding slot and a breaking unit which is extended from said operative member and is slidably coupled at said sliding cavity, wherein said mortice lock member is engaged with said breaking unit, such that when said operative member is actuated to slide along said sliding slot, said breaking unit is driven to slide at said sliding cavity to disengage with said mortice lock member so as to unlock said second body with said first body.

6. The jewelry storage device, as recited in claim 4, wherein said second body further has a sliding slot formed at an outer side of said second body and a sliding cavity formed at an inner side of said second body to communicate with said sliding slot, wherein said locking member comprises an operative member slidably coupled at said sliding slot and a breaking unit which is extended from said operative member and is slidably coupled at said sliding cavity, wherein said mortice lock member is engaged with said breaking unit, such that when said operative member is actuated to slide along said sliding slot, said breaking unit is driven to slide at said sliding cavity to disengage with said mortice lock member so as to unlock said second body with said first body.

7. The jewelry storage device, as recited in claim 5, wherein said locking unit further comprises a reinstate member supported in said sliding cavity to push said breaking unit toward said mortice lock member so as to ensure said breaking unit being engaged with said mortice lock member.

8. The jewelry storage device, as recited in claim 6, wherein said locking unit further comprises a reinstate member supported in said sliding cavity to push said breaking unit toward said mortice lock member so as to ensure said breaking unit being engaged with said mortice lock member.

9. The jewelry storage device, as recited in claim 7, wherein said second body further comprises two locating blocks provided at said front side of said second body, wherein two ends of said reinstate member are coupled with said locking blocks respectively to retain said reinstate member in position to bias against said breaking unit.

10. The jewelry storage device, as recited in claim 8, wherein said second body further comprises two locating blocks provided at said front side of said second body, wherein two ends of said reinstate member are coupled with said locking blocks respectively to retain said reinstate member in position to bias against said breaking unit.

11. The jewelry storage device, as recited in claim 9, wherein said breaking unit is integrally extended from said operative member.

12. The jewelry storage device, as recited in claim 10, wherein said breaking unit is integrally extended from said operative member.

* * * * *